US009751355B2

(12) United States Patent
Schaede et al.

(10) Patent No.: US 9,751,355 B2
(45) Date of Patent: Sep. 5, 2017

(54) PRINTED SECURITY FEATURE, OBJECT COMPRISING SUCH A PRINTED SECURITY FEATURE, AND PROCESS OF PRODUCING THE SAME

(71) Applicant: KBA-NOTASYS SA, Lausanne (CH)

(72) Inventors: Johannes Georg Schaede, Würzburg (DE); Alexander Fellmann, Zurich (DE)

(73) Assignee: KBA-NotaSys SA, Lausanne (CH)

( * ) Notice: Subject to any disclaimer, the term of this patent is extended or adjusted under 35 U.S.C. 154(b) by 158 days.

(21) Appl. No.: 14/890,305

(22) PCT Filed: May 13, 2014

(86) PCT No.: PCT/IB2014/061405

§ 371 (c)(1),
(2) Date: Nov. 10, 2015

(87) PCT Pub. No.: WO2014/184738

PCT Pub. Date: Nov. 20, 2014

(65) Prior Publication Data

US 2016/0176224 A1 Jun. 23, 2016

(30) Foreign Application Priority Data

May 13, 2013 (EP) ..... 13167568

(51) Int. Cl.
*B42D 25/387* (2014.01)
*B42D 25/00* (2014.01)
(Continued)

(52) U.S. Cl.
CPC ..... *B42D 25/387* (2014.10); *B41M 3/144* (2013.01); *B42D 25/29* (2014.10); *B42D 25/30* (2014.10);
(Continued)

(58) Field of Classification Search
CPC ..... B42D 25/387
(Continued)

(56) References Cited

U.S. PATENT DOCUMENTS 5,772,249 A 6/1998 Guex et al.
6,101,939 A 8/2000 Giori et al.
(Continued)

FOREIGN PATENT DOCUMENTS

CA 2 807 458 3/2012
EP 0 710 574 5/1996
(Continued)

OTHER PUBLICATIONS

International Search Report for PCT/IB2014/061405 dated Nov. 19, 2014, three pages.
(Continued)

*Primary Examiner* — Kyle Grabowski
(74) *Attorney, Agent, or Firm* — Nixon & Vanderhye P.C.

(57) ABSTRACT

There is described a printed security feature (1) provided onto a printable substrate, which security feature includes a printed area (100) consisting of a multiplicity of adjacent rectilinear and/or curvilinear elements (110, 120) printed with a given spatial frequency. The rectilinear and/or curvilinear elements are printed with at least first and second inks which exhibit the same or substantially the same optical appearance when illuminated with visible white light, such that the security feature produces a first graphical representation when illuminated with visible white light, at least the first ink being an ink which responds to non-visible light excitation by producing a characteristic optical response differentiating the first ink from the second ink. The security feature produces a second graphical representation when illuminated with non-visible light, which second graphical representation exhibits a distinctive two-dimensional
(Continued)

graphic element (B) which is revealed only when the security feature is illuminated with non-visible light. Inside boundaries (160) of the distinctive two-dimensional graphic element, a part (P3) of the rectilinear and/or curvilinear elements is printed with a combination of the first and second inks, the rectilinear and/or curvilinear elements being subdivided, within that part, into first and second juxtaposed sections (110*a*, 110*b*, 120*a*, 120*b*) which are respectively printed with the first ink and with the second ink. Outside the boundaries of the distinctive two-dimensional graphic element, portions (P1, P2) of the rectilinear and/or curvilinear elements are printed with only one of the at least first and second inks. The at least first and second inks are printed in register one with respect to the other so that the boundaries of the distinctive two-dimensional graphic element are not visible when the security feature is illuminated with visible white light and the distinctive two-dimensional graphic element only becomes visible when the security feature is illuminated with non-visible light.

23 Claims, 19 Drawing Sheets

(51) Int. Cl.

| | |
|---|---|
| ***B41M 3/14*** | (2006.01) |
| ***B42D 25/405*** | (2014.01) |
| ***B42D 25/29*** | (2014.01) |
| ***B42D 25/30*** | (2014.01) |

(52) U.S. Cl.
CPC ..... *B42D 25/405* (2014.10); *B42D 2035/14* (2013.01); *B42D 2035/16* (2013.01); *B42D 2035/24* (2013.01); *B42D 2035/26* (2013.01)

(58) Field of Classification Search
USPC ..... 283/91, 92
See application file for complete search history.

(56) References Cited

U.S. PATENT DOCUMENTS

| | | | | |
|---|---|---|---|---|
| 6,997,482 | B2 | 2/2006 | Mathys | |
| 8,523,238 | B2 | 9/2013 | Sekine et al. | |
| 8,821,996 | B2 | 9/2014 | Bala et al. | |
| 2004/0021311 | A1* | 2/2004 | Shimada | B42D 15/00 283/91 |
| 2004/0036272 | A1 | 2/2004 | Mathys | |
| 2007/0262579 | A1* | 11/2007 | Bala | B42D 25/29 283/92 |
| 2008/0299333 | A1* | 12/2008 | Bala | B42D 25/387 428/29 |
| 2008/0315574 | A1* | 12/2008 | Emerich | B42D 25/378 283/91 |
| 2010/0143578 | A1* | 6/2010 | Reichelsheimer | B41M 3/008 283/72 |
| 2011/0298204 | A1* | 12/2011 | Eschbach | B42D 25/29 283/67 |
| 2012/0251715 | A1* | 10/2012 | Dalal | B42D 25/378 283/85 |
| 2013/0127151 | A1 | 5/2013 | Sekine et al. | |
| 2013/0189455 | A1* | 7/2013 | Sekine | B42D 25/387 428/29 |
| 2013/0221656 | A1* | 8/2013 | Sekine | B42D 25/387 283/92 |

FOREIGN PATENT DOCUMENTS

| | | |
|---|---|---|
| EP | 0 949 069 | 10/1999 |
| EP | 1 291 195 | 3/2003 |
| EP | 1 997 644 | 12/2008 |
| EP | 2 028 017 | 2/2009 |

OTHER PUBLICATIONS

Written Opinion for PCT/IB2014/061405 dated Nov. 19, 2014, four pages.
Co-pending U.S. Appl. No. 14/890,346, filed Nov. 10, 2015.

* cited by examiner

PRINTED SECURITY FEATURE, OBJECT COMPRISING SUCH A PRINTED SECURITY FEATURE, AND PROCESS OF PRODUCING THE SAME

This application is the U.S. national phase of International Application No. PCT/IB2014/061405 filed 13 May 2014 which designated the U.S. and claims priority to EP Patent Application No. 13167568.8 filed 13 May 2013, the entire contents of each of which are hereby incorporated by reference.

TECHNICAL FIELD

The present invention generally relates to a printed security feature provided onto a printable substrate, which printed security feature includes a printed area consisting of a multiplicity of adjacent rectilinear and/or curvilinear elements printed with a given spatial frequency.

BACKGROUND OF THE INVENTION

European Patent Publications Nos. EP 0 710 574 A2 and EP 1 291 195 A1 each disclose such printed security features.

Further improvements of these known printed security features are required in order to make forgery by counterfeiters even more difficult.

SUMMARY OF THE INVENTION

A general aim of the invention is therefore to improve the known printed security features.

More specifically, an aim of the present invention is to provide such a printed security feature that is both difficult to counterfeit and requires high-precision printing equipment for it to be produced in an adequate manner.

Still another aim of the invention is to provide such a solution which enables the creation of a simple and readily understandable optical effect when illuminated by means of non-visible light, such as ultraviolet light, and which requires simple tools (such as suitable UV light) in order to control the genuineness of the security feature.

These aims are achieved thanks to a printed security feature defined in the claims.

There is accordingly provided a printed security feature provided onto a printable substrate, which printed security feature includes a printed area consisting of a multiplicity of adjacent rectilinear and/or curvilinear elements printed with a given spatial frequency. According to the invention, the rectilinear and/or curvilinear elements are printed with at least first and second inks which exhibit the same or substantially the same optical appearance when illuminated with visible white light, such that the printed security feature produces a first graphical representation when illuminated with visible white light, at least the first ink being an ink which responds to non-visible light excitation by producing a characteristic optical response differentiating the first ink from the second ink—The printed security feature produces a second graphical representation when illuminated with non-visible light, which second graphical representation exhibits a distinctive two-dimensional graphic element which is revealed only when the printed security feature is illuminated with non-visible light. Inside boundaries of the distinctive two-dimensional graphic element, a part of the rectilinear and/or curvilinear elements is printed with a combination of the first and second inks, the rectilinear and/or curvilinear elements being subdivided, within that part, into first and second juxtaposed sections, the first juxtaposed sections being printed with the first ink and the second juxtaposed sections being printed with the second ink. Outside the boundaries of the distinctive two-dimensional graphic element, portions of the rectilinear and/or curvilinear elements are printed with only one of the at least first and second inks. The at least first and second inks are printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

A key advantage of the present invention resides in the fact that it requires a precise printing process in order to print the at least first and second inks with the adequate register, which printing process is not readily available to counterfeiters. A misregistration between the colours will result in the boundaries of the distinctive two-dimensional graphic element becoming visible under visible light, thereby revealing the presence of the two-dimensional graphic element which is normally concealed under visible light.

The printed security feature may advantageously be such that, outside the boundaries of the distinctive two-dimensional graphic element, a first portion the rectilinear and/or curvilinear elements is printed only with the first ink and a second portion of the rectilinear and/or curvilinear elements is printed only with the second ink. Preferably, the printed security feature may further be such that, the rectilinear and/or curvilinear elements are further printed with at least third and fourth inks which exhibit the same or substantially the same optical appearance when illuminated with visible white light, which optical appearance of the third and fourth inks is different from the optical appearance of the first and second inks. In this context, the third ink is an ink which responds to non-visible light excitation by producing a characteristic optical response differentiating the third ink from the fourth ink, which characteristic optical response of the third ink is the same or substantially the same as the characteristic optical response of the first ink. In such case, inside the boundaries of the distinctive two-dimensional graphic element, a second part of the rectilinear and/or curvilinear elements is printed with a combination of the third and fourth inks, the rectilinear and/or curvilinear elements being subdivided, within that second part, into first and second juxtaposed sections, the first juxtaposed sections being printed with the third ink and the second juxtaposed sections being printed with the fourth ink. Outside the boundaries of the distinctive two-dimensional graphic element, a third portion of the rectilinear and/or curvilinear elements is printed only with the third ink, and a fourth portion of the rectilinear and/or curvilinear elements is printed only with the fourth ink. The third and fourth inks are likewise printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

Preferably, the first graphical representation exhibits a first two-dimensional graphic element which is distinguishable from the distinctive two-dimensional graphic element that becomes visible when the printed security feature is illuminated with non-visible light, the first two-dimensional graphic element and the distinctive two-dimensional graphic element being positioned in a partially overlapping manner within the printed area.

In one variant of this preferred embodiment (see FIGS. 1 to 5), the first two-dimensional graphic element and the distinctive two-dimensional graphic element have identical shapes (e.g. a triangular shape in the illustrated example) and are designed in such a way that commutation between the first two-dimensional graphic element and the distinctive two-dimensional graphic element gives the impression of a flip or movement of a same graphic element from one position to another (e.g. a triangular shape pointing downwards or upwards).

In another variant of this preferred embodiment (see FIGS. 6 to 10), the first two-dimensional graphic element and the distinctive two-dimensional graphic element have different shapes each providing recognizable information (e.g. the numerical symbols "1" and "2" in the illustrated example) and are designed in such a way that commutation between the first two-dimensional graphic element and the distinctive two-dimensional graphic element leads to a recognizable change in information (e.g. a change between the numerical symbol "1" and the numerical symbol "2").

Advantageously, the multiplicity of adjacent rectilinear and/or curvilinear elements include a first set of rectilinear and/or curvilinear elements extending over a first zone of the printed area and at least a second set of rectilinear and/or curvilinear elements extending over a second zone of the printed area, which helps in defining a first graphical representation that can suitably be identified in the state where the printed security feature is illuminated with visible white light. In that context, it is preferable to design the rectilinear and/or curvilinear elements of the first set so that they extend along a first orientation and the rectilinear and/or curvilinear elements of the second set so that they extend along a second orientation different from the first orientation. Likewise, the first and second sets of rectilinear and/or curvilinear elements can advantageously be separated by an unprinted borderline.

In accordance with a particularly preferred embodiment (as discussed hereinafter), the first ink is a first fluorescent ink which produces a visible response having a first fluorescent colour when subjected to the non-visible light excitation (preferably ultraviolet excitation), the first fluorescent colour contributing to making the distinctive two-dimensional graphic element visible when the printed security feature is subjected to the non-visible light excitation. According to a particularly advantageous variant of this preferred embodiment, the second ink is a second fluorescent ink which produces a visible response having a second fluorescent colour when subjected to the non-visible light excitation, which second fluorescent colour is distinct from the first fluorescent colour. Accordingly, inside the boundaries of the distinctive two-dimensional graphic element, the first and second juxtaposed sections of the rectilinear and/or curvilinear elements produce, when subjected to the non-visible light excitation, a third fluorescent colour resulting from additive mixture of the first and second fluorescent colours.

In yet another embodiment which adopts four different inks as mentioned above, the first ink is a first fluorescent ink which produces a visible response having a first fluorescent colour when subjected to the non-visible light excitation (preferably ultraviolet excitation), the first fluorescent colour contributing to making the distinctive two-dimensional graphic element visible when the printed security feature is subjected to the non-visible light excitation, and the third ink is a fluorescent ink which produces a visible response having the same or substantially the same first fluorescent colour as the first fluorescent ink when subjected to the non-visible light excitation. According to a particularly advantageous variant of this other embodiment, the second ink is a second fluorescent ink which produces a visible response having a second fluorescent colour when subjected to the non-visible light excitation, which second fluorescent colour is distinct from the first fluorescent colour, and the fourth ink is a fluorescent ink which produces a visible response having the same or substantially the same second fluorescent colour as the second fluorescent ink when subjected to the non-visible light excitation. Accordingly, inside the boundaries of the distinctive two-dimensional graphic element, the first and second juxtaposed sections of the rectilinear and/or curvilinear elements produce, when subjected to the non-visible light excitation, a third fluorescent colour resulting from additive mixture of the first and second fluorescent colours.

In accordance with the invention, the rectilinear and/or curvilinear elements preferably exhibit a line width in the range of 20 μm to 200 μm. The line width of the rectilinear and/or curvilinear elements can be constant, it being however to be appreciated that the line width of the rectilinear and/or curvilinear elements could be modulated so as to represent an additional piece of information.

Preferably, the rectilinear and/or curvilinear elements are printed with a spatial frequency of 2 to 50 lines per millimeter, which ensures homogenous graphical representations both when the security feature is illuminated with visible white light and when the security feature is illuminated with non-visible light (e.g. UV light).

A ratio of a surface of the first juxtaposed sections over a surface of the second juxtaposed sections, inside the boundaries of the distinctive two-dimensional graphic element, can conveniently lie within a range of ½ to 2, which provides flexibility to modulate the intensity of the colour appearance of the distinctive two-dimensional graphic element when it is revealed as a result of illumination of the printed security feature with non-visible light. This is especially useful in order to modulate the respective contributions of first and second fluorescent inks discussed above (and third and fourth fluorescent inks as the case may be), thereby allowing an adjustment of the third fluorescent colour resulting from additive mixture of the first and second fluorescent colours.

The multiplicity of adjacent rectilinear and/or curvilinear elements is preferably printed by Simultan-offset, namely by inking first and second offset printing plates with the first and second inks, respectively, and by transferring resulting first and second ink patterns from the first and second offset printing plates onto a common blanket cylinder prior to printing. Other printing processes could be contemplated (such as intaglio printing) provided the printing process is adapted to print the multiplicity of adjacent rectilinear and/or curvilinear elements with an adequate register between the first and second inks.

Also claimed is an object comprising a substrate and a printed security feature in accordance with the invention, which printed security feature is provided onto the substrate. In this context, the printed security feature is advantageously provided on a portion of the substrate which absorbs a substantial part of the non-visible light excitation. This portion can either be a portion of the substrate itself or a suitable layer applied onto the substrate prior to printing of the security feature. This portion ensures a better contrast between the security feature and the background (when illuminated with non-visible light) as the background will appear mostly dark under illumination with non-visible light.

The object can be a value document (in particular a high security document such as a banknote), or a security element that is applicable onto an article to be protected against forgery (in particular a foil element, such as a transferable foil element that can be transferred by e.g. hot-stamping or a foil element that can be laminated onto a suitable surface of the article).

Also claimed is a process of producing an object comprising a substrate and a printed security feature, wherein the process includes providing a printable substrate and printing the security feature in accordance with the invention onto the substrate.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1:
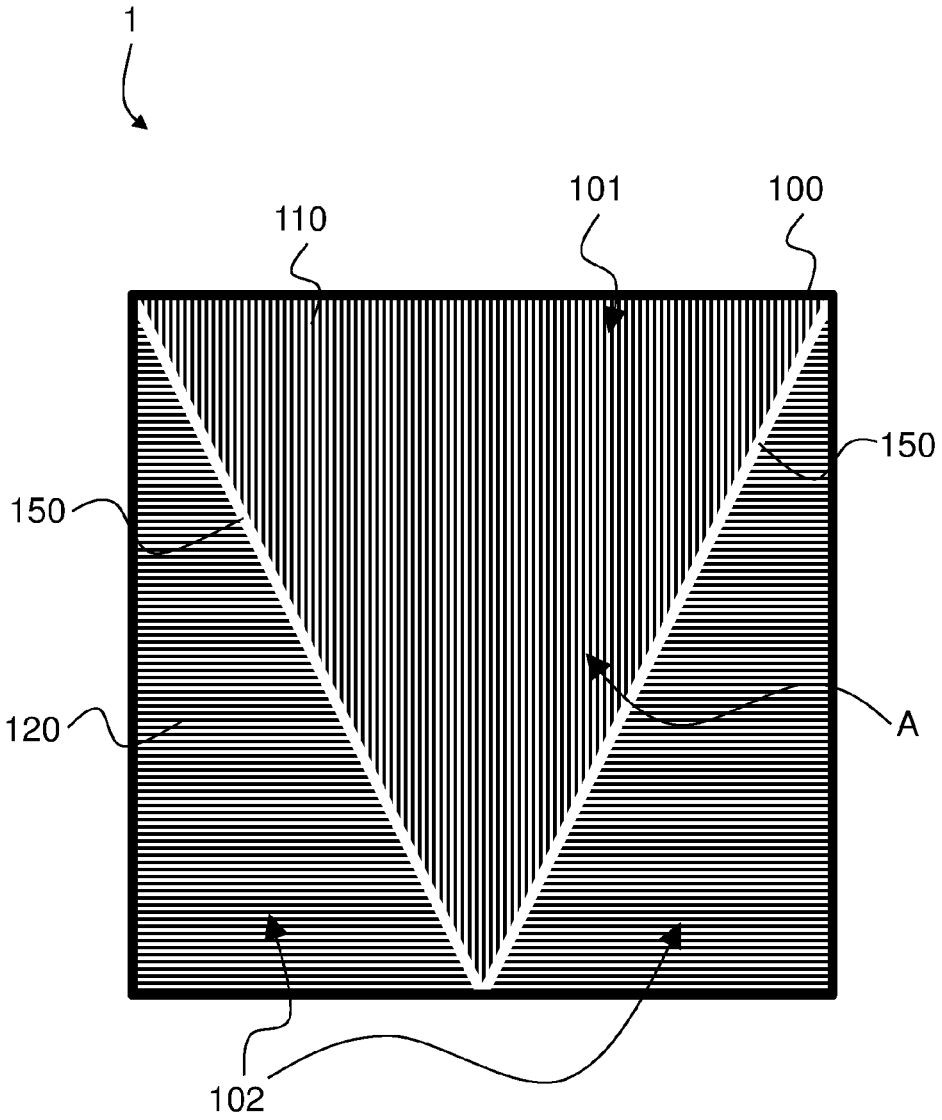
FIG. 1 is a schematic view of a printed security feature in accordance with a first embodiment of the invention, FIG. 1 illustrating the printed security feature when illuminated with visible white light.
Figure 2:
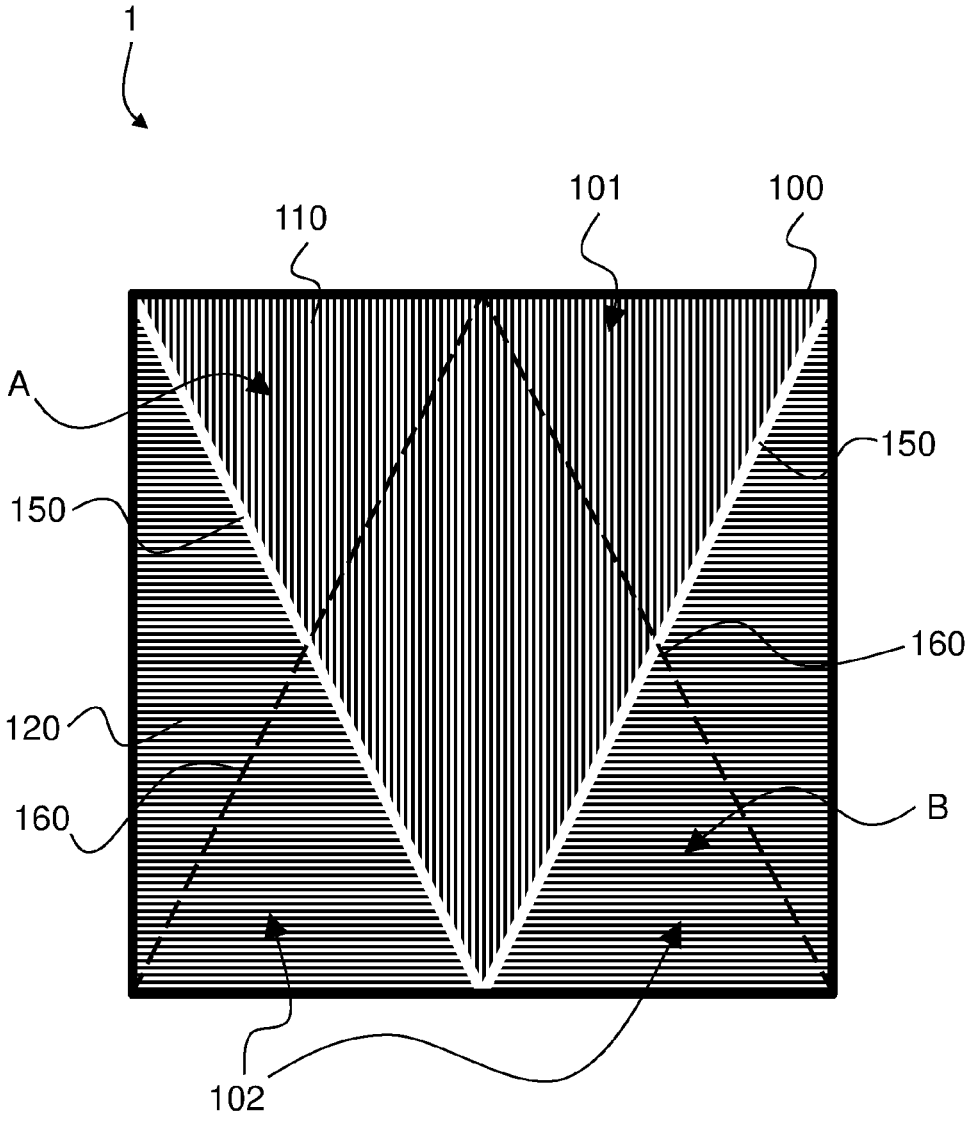
FIG. 2 is a schematic view of the printed security feature of FIG. 1 where boundaries of a distinctive two-dimensional graphic element (which element is designated generally by reference B) are shown in dashed lines, this distinctive two-dimensional graphic element being revealed only when the printed feature is illuminated with non-visible light (e.g. ultraviolet light)

The present invention will be described in the particular context of a printed security feature which is printed by means of at least first and second fluorescent inks which produce corresponding visible responses when subjected to non-visible light excitation, the first and second inks producing distinct visible responses having respectively first and second fluorescent colours which are different from one another. In the examples that will be described hereinafter, the first fluorescent ink is an ink that fluoresces a green colour, while the second fluorescent ink is an ink that fluoresces a red colour. These examples are purely illustrative and other fluorescent colours could be contemplated without departing from the scope of the invention as defined by the claims. As this will be appreciated hereinafter, the first and second fluorescent inks advantageously combine, in certain locations of the printed security feature, to form a third fluorescent colour resulting from additive mixture of the first and second fluorescent colour. In the following, it will be assumed that each of the first and second fluorescent colours contribute equally to the third fluorescent colour, thereby leading to a yellow fluorescent colour in the examples. It will however be appreciated that the third colour will actually be dependent on the relevant contributions of the first and second fluorescent colours in the additive mixture. The more the red contribution, the more the third colour will turn from yellow to orange and to red. The more the green contribution, the more the third colour will turn to a light green and to green.

It the present example, it will be assumed that the non-visible light excitation is ultraviolet excitation. It is however to be appreciated that the non-visible light excitation could alternatively be a near-infrared excitation or any other excitation outside the visible spectrum that can suitably trigger a visible response. Within the scope of the present invention, only one or more than two inks responsive to the non-visible light excitation could be contemplated.

FIGS. 1 to 5 show a printed security feature (generally identified by reference numeral 1) in accordance with a first embodiment of the invention, which printed security feature 1 is characterized by the fact that the first graphical representation of the printed security feature (under visible light) exhibits a first two-dimensional graphic element A (namely a triangular shape pointing downwards—see FIGS. 1 to 3A-3B) which is distinguishable from the distinctive two-dimensional graphic element B (namely a triangular shape pointing upwards—see FIGS. 2 to 5) that becomes visible when the printed security feature is illuminated with non-visible light, the first two-dimensional graphic element A and the distinctive two-dimensional graphic element B being positioned in a partially overlapping manner within the printed area of the security feature 1 (see FIG. 2), which printed area is designated by reference numeral 100 in FIGS. 1 to 5. Boundaries of the distinctive two-dimensional graphic element B are depicted by dashed lines in FIGS. 2 to 5 and are designated by reference numeral 160. In the example of FIGS. 1 to 5, the first two-dimensional graphic element A and the distinctive two-dimensional graphic element B have identical shapes (i.e. a triangular shape in the illustrated example) and are designed in such a way that commutation between the first two-dimensional graphic element A and the distinctive two-dimensional graphic element B gives the impression of a flip or movement of a same graphic element from one position to another (namely a triangular shape pointing downwards or upwards).

In contrast, FIGS. 6 to 10 show a printed security feature (generally identified by reference numeral 1*) in accordance with a second embodiment of the invention, which printed security feature 1* is characterized by the fact that the first graphical representation of the printed security feature (under visible light) exhibits a first two-dimensional graphic element C (namely the numerical symbol "1"—see FIGS. 6 to 8A-8C) which is distinguishable from the distinctive two-dimensional graphic element D (namely the numerical symbol "2"—see FIGS. 7 to 10) that becomes visible when the printed security feature is illuminated with non-visible light, the first two-dimensional graphic element C and the distinctive two-dimensional graphic element D being positioned in a partially overlapping manner within the printed area of the security feature 1* (see FIG. 7), which printed area is designated by reference numeral 200 in FIGS. 6 to 10. Boundaries of the distinctive two-dimensional graphic element D are depicted by dashed lines in FIGS. 7 to 10 and are designated by reference numeral 260. In the example of FIGS. 6 to 10, the first two-dimensional graphic element C and the distinctive two-dimensional graphic element D have different shapes each providing recognizable information (i.e. the numerical symbols "1" and "2" in the illustrated example) and are designed in such a way that commutation between the first two-dimensional graphic element C and the distinctive two-dimensional graphic element D leads to a recognizable change in information (namely a change between the numerical symbol "1" and the numerical symbol "2").

In both embodiments, the printed area 100, respectively 200, consists of a multiplicity of parallel rectilinear elements designated by reference numerals 110, 120 in FIGS. 1 to 5 and by reference numerals 210, 220 in FIGS. 6 to 10. These rectilinear elements 110, 120, respectively 210, 220, are printed with a given spatial frequency which is preferably of the order of 2 to 50 lines per millimeter. While the Figures show rectilinear elements 110, 120, respectively 210, 220, the invention is equally applicable to security features including a printed area consisting of a multiplicity of adjacent curvilinear elements (such as adjacent waves, concentric circles, or any other non rectilinear elements that can be printed in the way of a multiplicity of adjacent elements). Combinations of rectilinear and curvilinear elements are also possible.

Preferably, the multiplicity of parallel rectilinear elements 110, 120 of FIGS. 1 to 5, include a first set of rectilinear elements 110 extending over a first zone 101 of the printed area 100 and at least a second set of rectilinear elements 120 extending over a second zone 102 of the printed area 100. Likewise, the multiplicity of parallel rectilinear elements 210, 220 of FIGS. 6 to 10, include a first set of rectilinear elements 210 extending over a first zone 201 of the printed area 200 and at least a second set of rectilinear elements 220 extending over a second zone 202 of the printed area 200. This helps in defining a first graphical representation that can suitably be identified in the state where the printed security feature is illuminated with visible white light.

In that context, it is preferable to design the rectilinear elements of the first set 110, respectively 210, so that they extend along a first orientation (namely vertically in the examples) and the rectilinear elements of the second set 120, respectively 220, so that they extend along a second orientation different from the first orientation (namely horizontally in the illustrated examples). In addition, in the illustrations of FIGS. 1 to 10, the first and second sets 110, 120, respectively 210, 220 of rectilinear elements are separated by an unprinted borderline designated by reference numeral 150 in FIGS. 1 to 5 and by reference numeral 250 in FIGS. 6 to 10.

In the illustrated examples, the elements 110, 120, respectively 210, 220, preferably have a constant line width w, which line width w can conveniently be selected to be in the range of 20 μm to 200 μm. Within the scope of the present invention, a modulation of the line width can however be contemplated so as to represent an additional piece of information. In the illustrated examples, it will be assumed that the elements 110, 120, respectively 210, 220, have a line width of the order of 100 μm and that the spatial frequency of the elements 110, 120, respectively 210, 220, is of the order of 5 lines per millimeters. The unprinted borderline 150, respectively 250, exhibits a width of the order of 150 μm in the illustrated examples.

In accordance with the invention, the rectilinear elements 110, 120, respectively 210, 220, are printed with at least first and second inks which exhibit the same or substantially the same optical appearance when illuminated with visible white light, such that the printed security feature 1, respectively 1*, produces a first graphical representation (FIG. 1, FIG. 6) when illuminated with visible white light. As already mentioned, the first and second inks are preferably first and second fluorescent inks having distinctive fluorescent colours (namely green and red in this example).

Figure 3A:
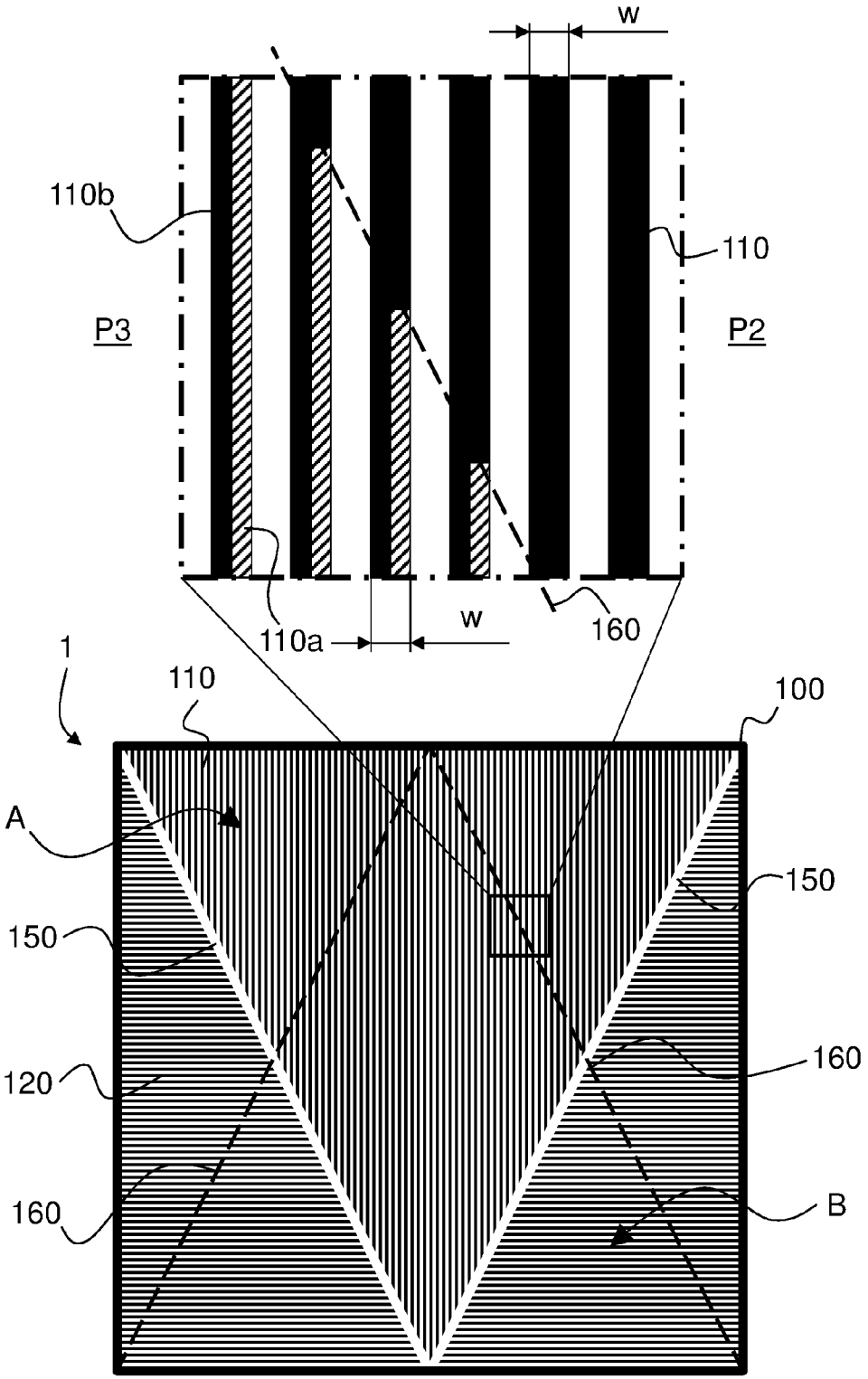
FIGS. 3A and 3B are detailed views of first and second partial areas of the printed security feature of FIG. 1 showing details of the rectilinear elements constituting the printed area of the security feature, inside and outside of the boundaries of the distinctive two-dimensional graphic element.
Figure 3B:
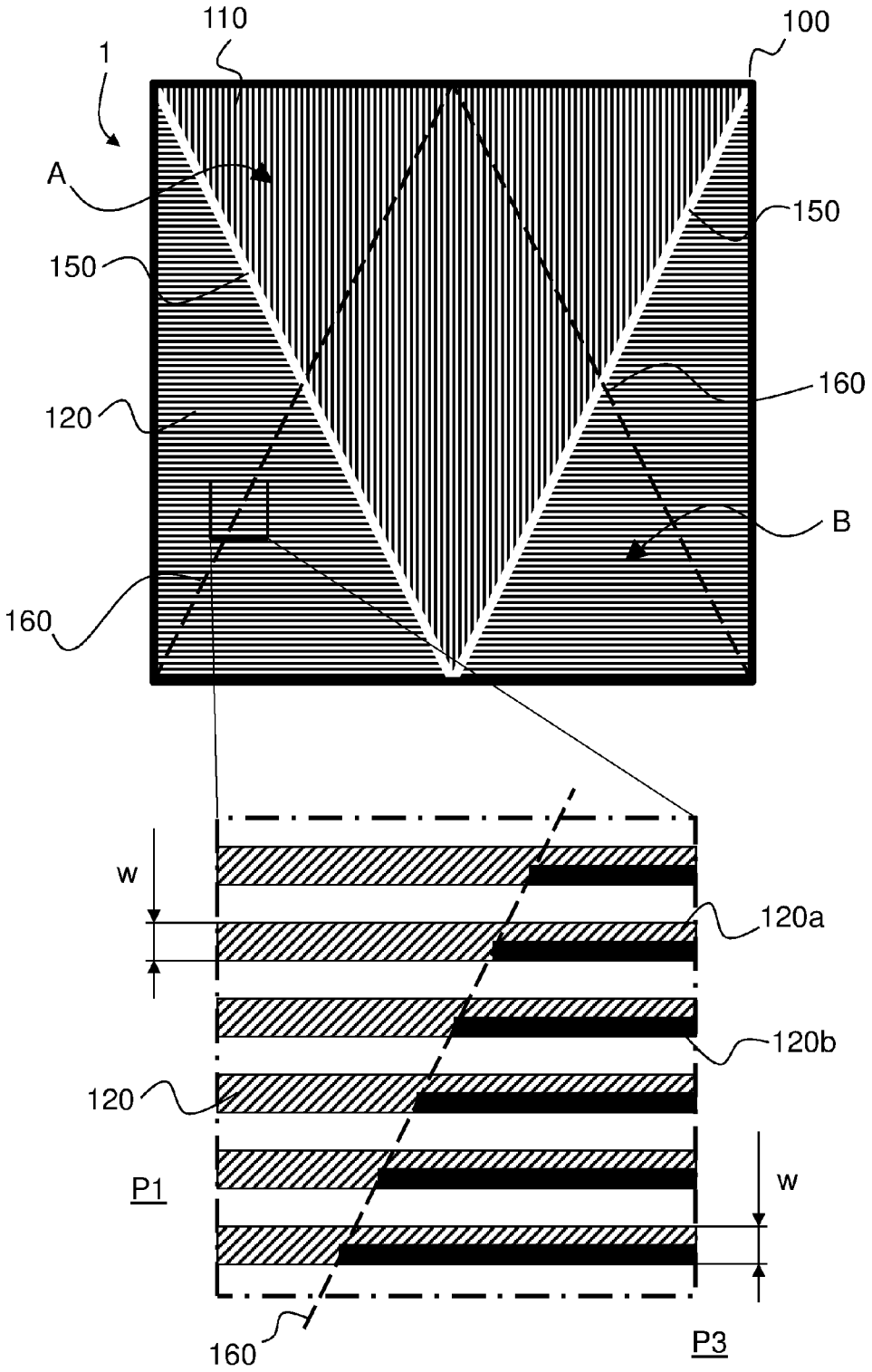

Referring to FIGS. 3A and 3B, one can see that, inside the boundaries 160 of the two-dimensional graphic element B, the rectilinear elements 110, 120 are subdivided into first and second juxtaposed sections 110*a*, 110*b* (see FIG. 3A), respectively 120*a*, 120*b* (see FIG. 3B). In other words, the first and second juxtaposed sections 110*a*, 110*b*, respectively 120*a*, 120*b*, are printed so as to join one with the other and be contiguous. The first juxtaposed sections 110*a*, 120*a* are printed with the first fluorescent ink (i.e. the fluorescent green ink—identified by hatchings in FIGS. 3A and 3B), while the second juxtaposed sections 110*b*, 120*b* are printed with the second ink (i.e. the fluorescent red ink—identified by a solid colour in FIGS. 3A and 3B). Outside the boundaries 160 of the two-dimensional graphic element B, the rectilinear elements 110, 120 are printed with only the first ink (see e.g. FIG. 3B) or the second ink (see e.g. FIG. 3A).

Figure 8A:
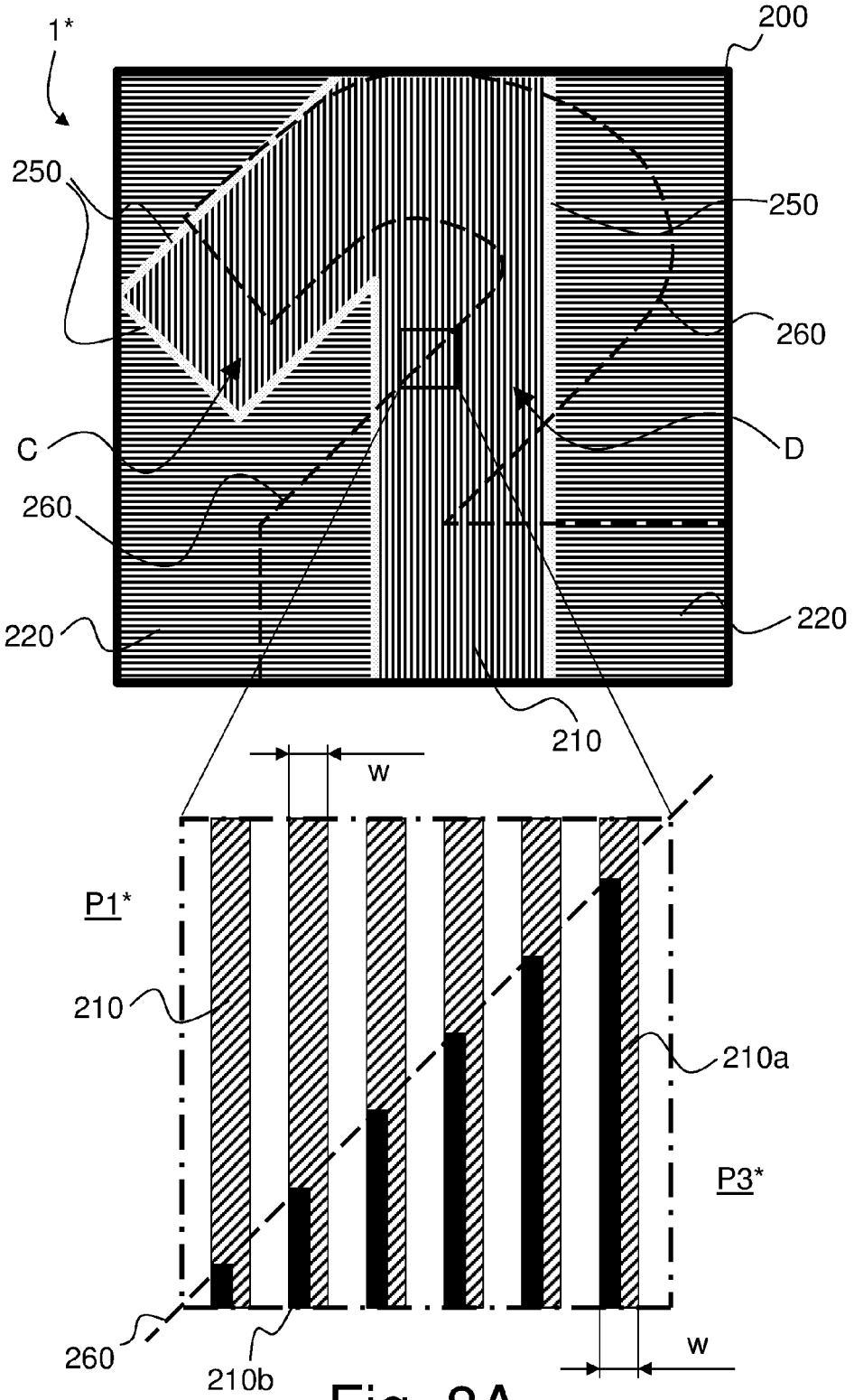
FIGS. 8A to 8C are detailed views of first, second and third partial areas of the printed security feature of FIG. 6 showing details of the rectilinear elements constituting the printed area of the security feature, inside and outside of the boundaries of the distinctive two-dimensional graphic element.
Figure 8B:
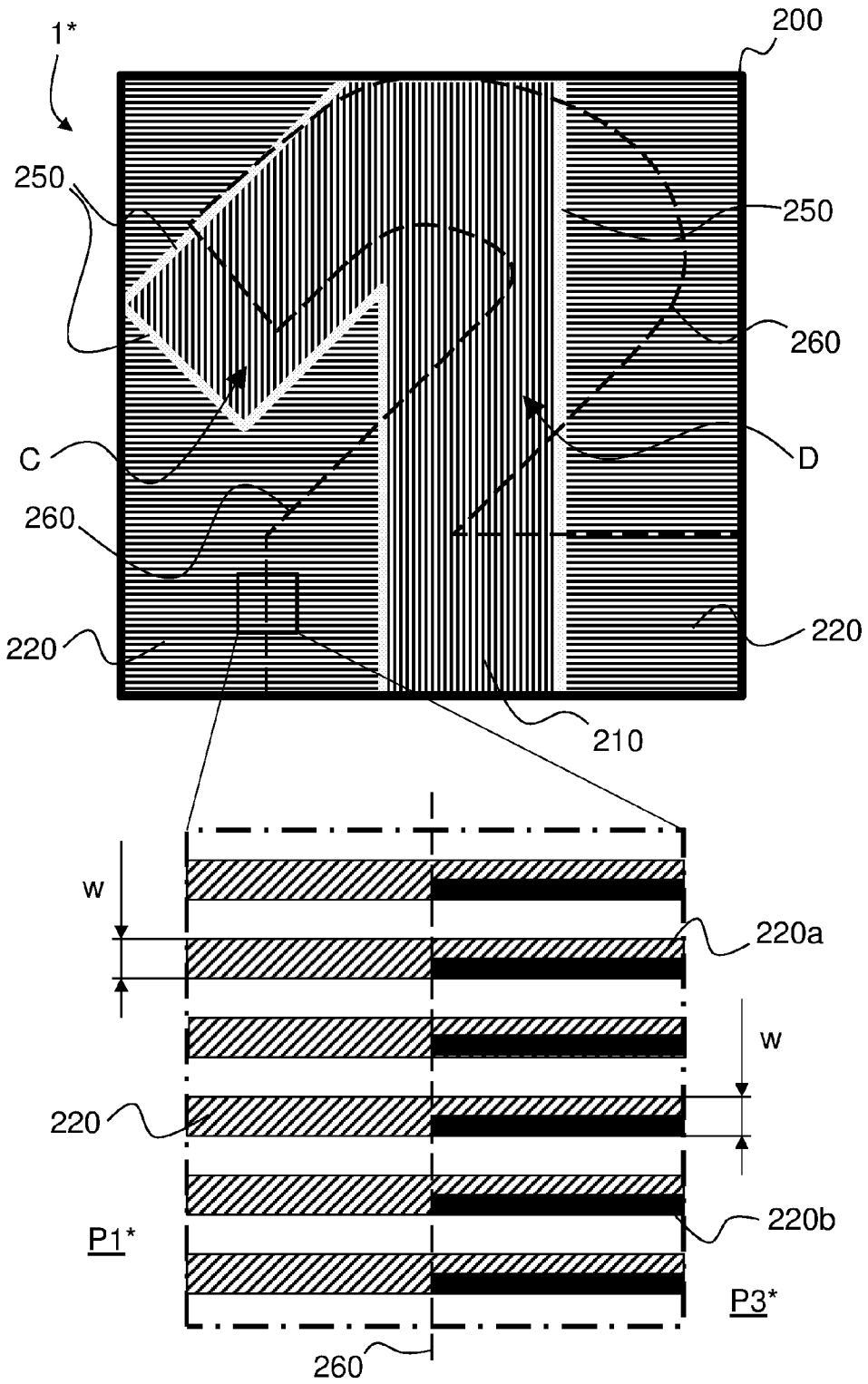
Figure 8C:
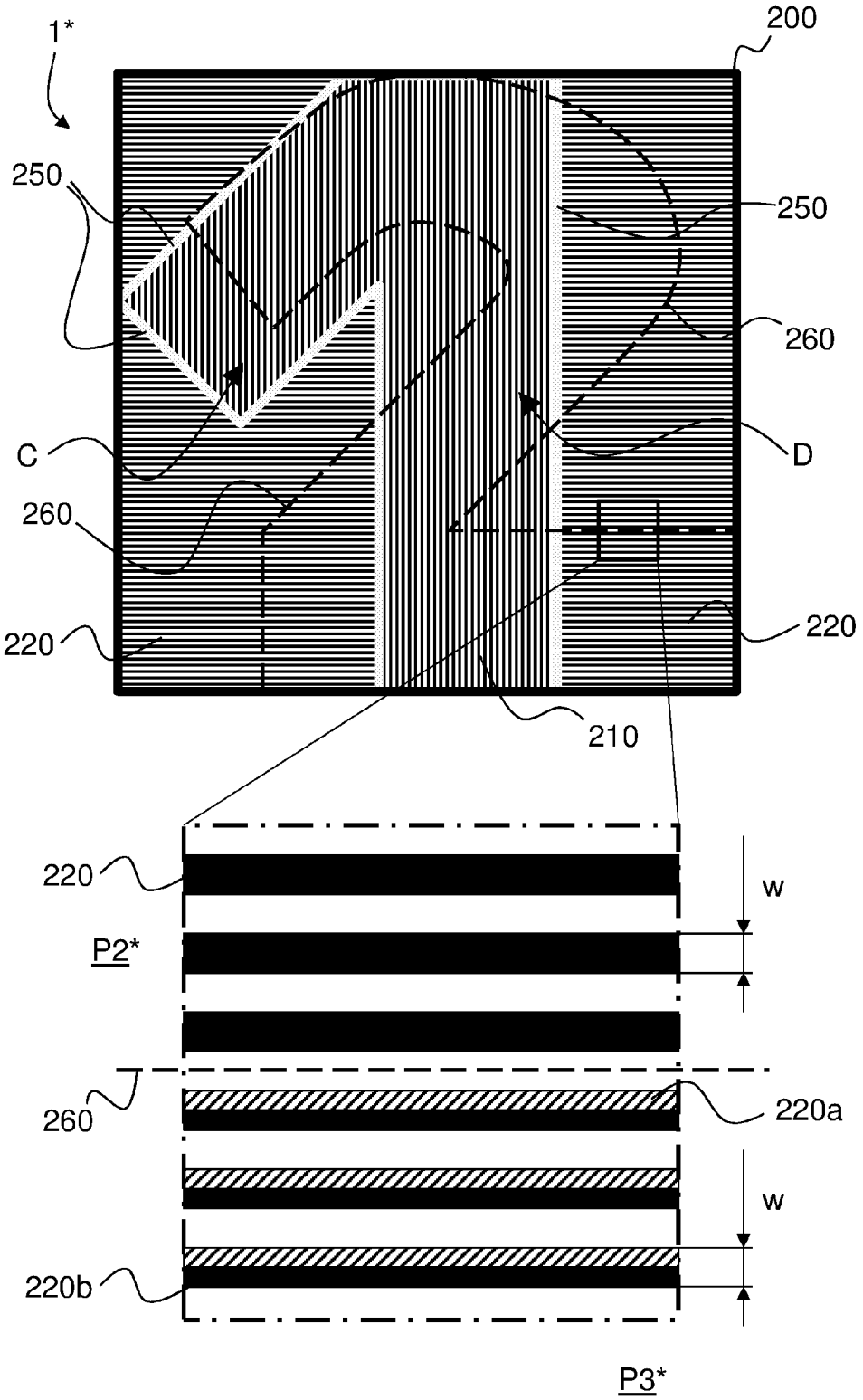

Similarly, referring to FIGS. 8A to 8C, one can see that, inside the boundaries 260 of the two-dimensional graphic element D, the rectilinear elements 210, 220 are subdivided into first and second juxtaposed sections 210*a*, 210*b* (see FIG. 8A), respectively 220*a*, 220*b* (see FIGS. 8B and 8C). In other words, the first and second juxtaposed sections 210*a*, 210*b*, respectively 220*a*, 220*b*, are printed so as to join one with the other and be contiguous. The first juxtaposed sections 210*a*, 220*a* are printed with the first fluorescent ink (i.e. the fluorescent green ink—identified by hatchings in FIGS. 8A to 8C), while the second juxtaposed sections 210*b*, 220*b* are printed with the second ink (i.e. the fluorescent red ink—identified by a solid colour in FIGS. 8A to 8C). Outside the boundaries 260 of the two-dimensional graphic element D, the rectilinear elements 210, 220 are printed with only the first ink (see e.g. FIGS. 8A and 8B) or the second ink (see e.g. FIG. 8C).

In both instances, the first and second inks are printed in register one with respect to the other so that the boundaries 160, respectively 260, of the two-dimensional graphic element B, respectively D, are not visible when the printed security feature is illuminated with visible white light and the two-dimensional graphic element B, respectively D, only becomes visible when the printed security feature is illuminated with non-visible light.

Figure 4:
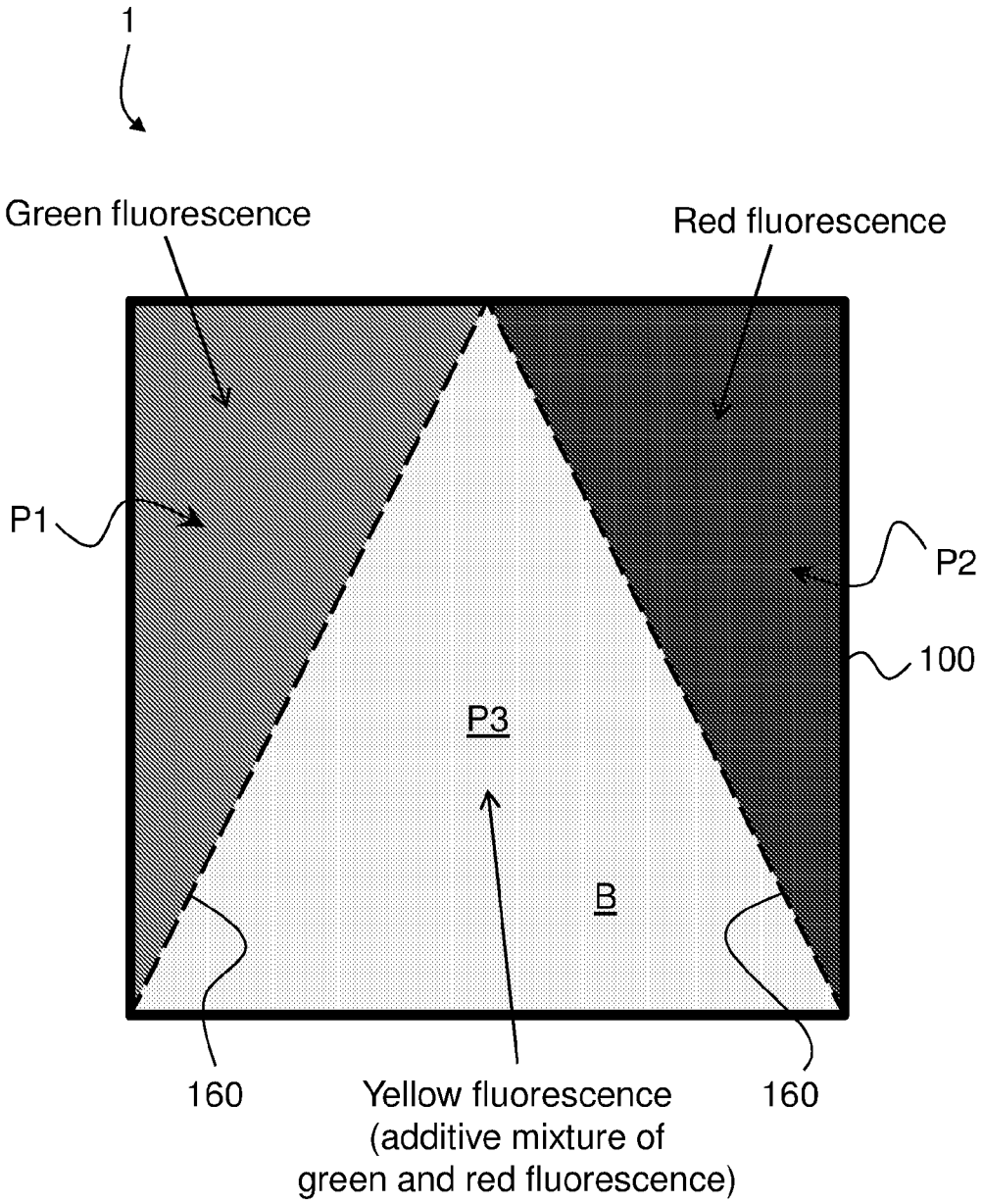
FIG. 4 is a schematic illustration of the spatial distribution of first, second and third fluorescent colours which are produced by the security feature of FIG. 1 when subjected to non-visible light excitation, namely ultraviolet excitation in this example.

Indeed, as illustrated by FIG. 4, the arrangement of the first and second inks is such that, when the security feature 1 is subjected to ultraviolet excitation, the portion P1 of the rectilinear elements 110, 120, outside the boundaries 160 of the two-dimensional graphic element B, that is entirely printed with the first ink appears as a fluorescent green region (triangular area at the upper-left corner of the printed area 100 in FIG. 4) while the portion P2 of the rectilinear elements 110, 120, outside the boundaries 160 of the two-dimensional graphic element B, that is entirely printed with the second ink appears as a fluorescent red region (triangular area at the upper-right corner of the printed area 100 in FIG. 4). The remaining portion P3 of the rectilinear elements 110, 120, inside the boundaries 160 of the two-dimensional graphic element B (i.e. the portion forming the triangular shape pointing upwards), that is printed with a combination of the first and second fluorescent inks appears as a fluorescent yellow region thanks to the additive mixture of the fluorescent green and red colours.

Figure 9:
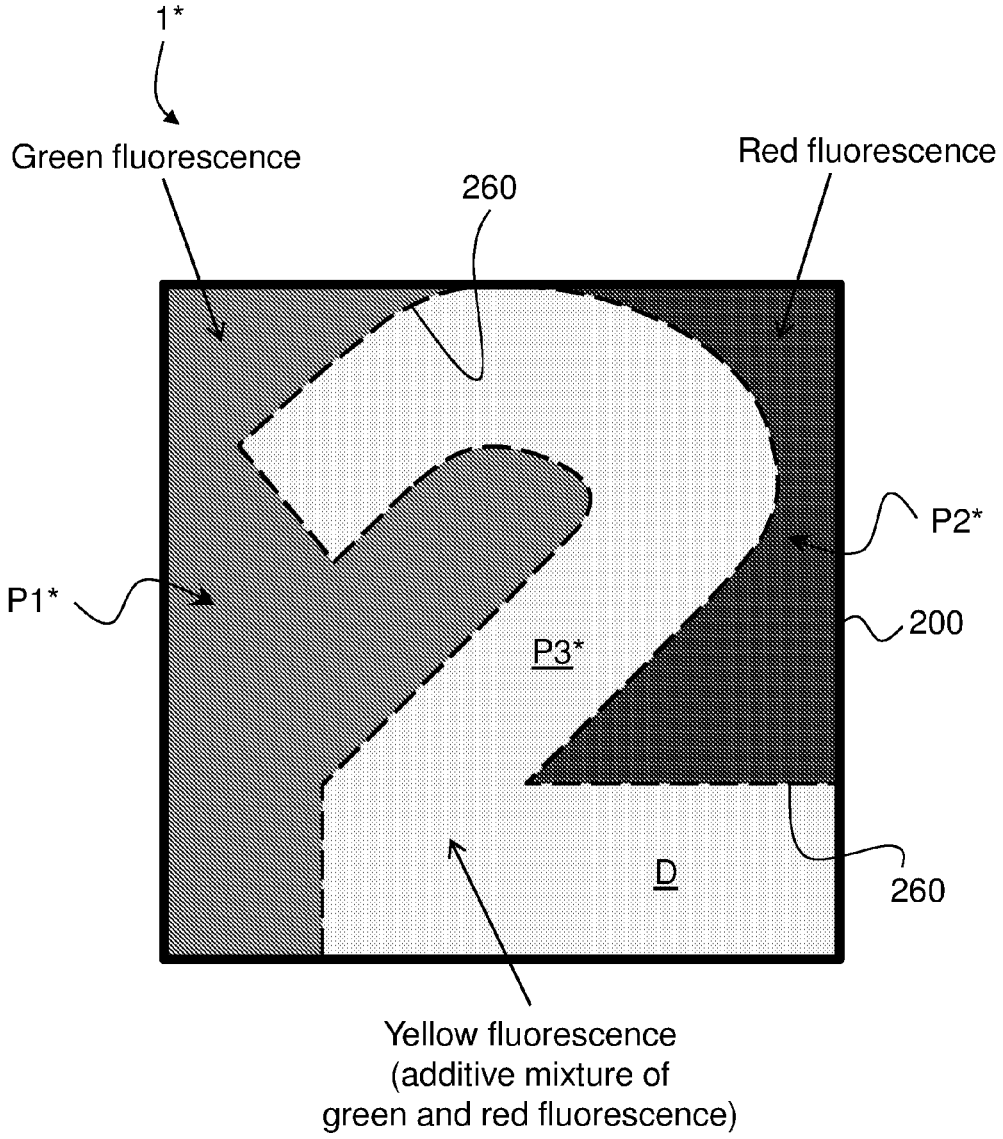
FIG. 9 is a schematic illustration of the spatial distribution of first, second and third fluorescent colours which are produced by the security feature of FIG. 6 when subjected to non-visible light excitation, namely ultraviolet excitation in this example.

The same is true in respect of the embodiment of FIGS. 6 to 10. Indeed, as illustrated by FIG. 9, the arrangement of the first and second inks is such that, when the security feature 1* is subjected to ultraviolet excitation, the portion P1* of the rectilinear elements 210, 220, outside the boundaries 260 of the two-dimensional graphic element D, that is entirely printed with the first ink appears as a fluorescent green region (portion of the background on the left-hand side of the numerical symbol "2" in FIG. 9) while the portion P2* of the rectilinear elements 210, 220, outside the boundaries 260 of the two-dimensional graphic element D, that is entirely printed with the second ink appears as a fluorescent red region (portion of the background on the right-hand side of the numerical symbol "2" in FIG. 9). The remaining portion P3* of the rectilinear elements 210, 220, inside the boundaries 260 of the two-dimensional graphic element D (i.e. the portion forming the numerical symbol "2"), that is printed with a combination of the first and second fluorescent inks appears as a fluorescent yellow region thanks to the additive mixture of the fluorescent green and red colours.

Figure 5:
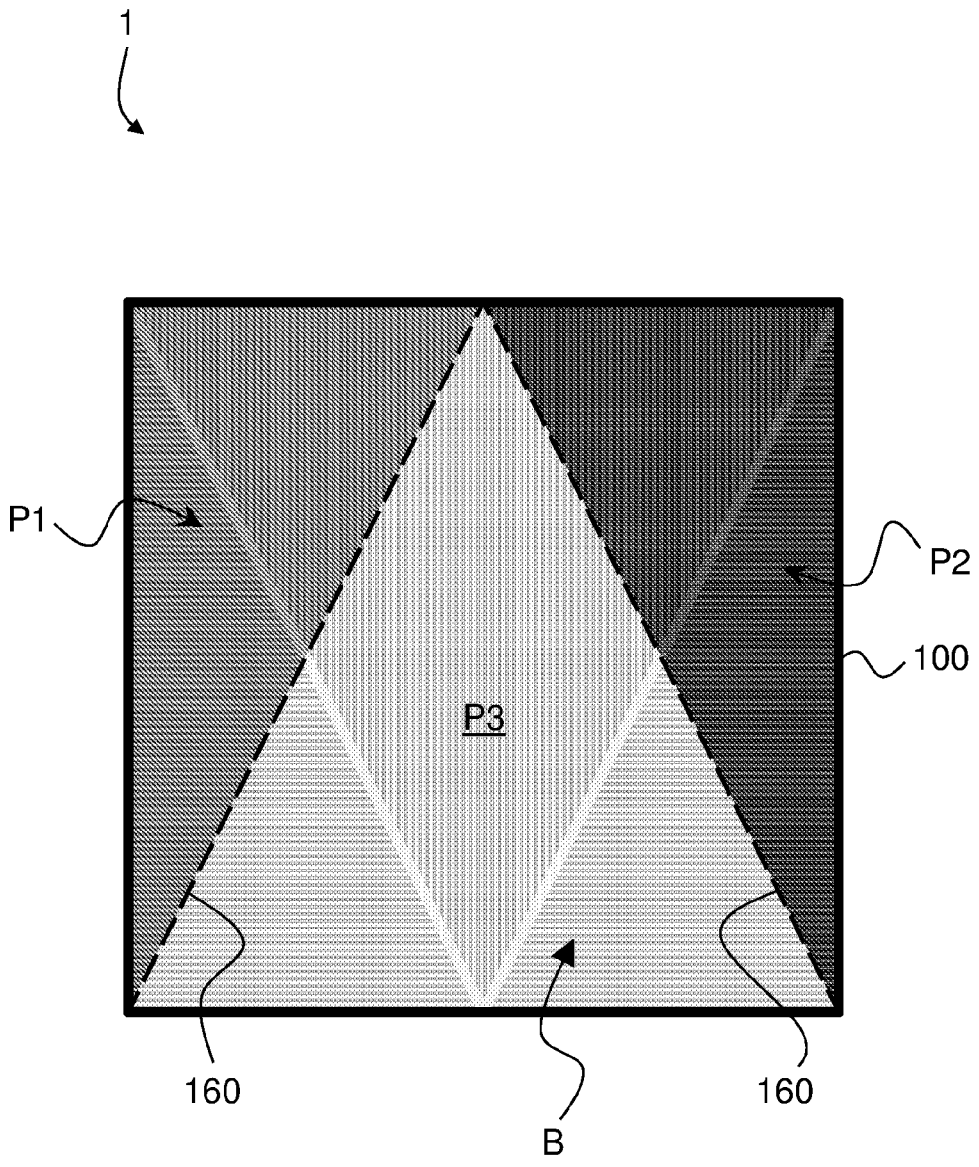
FIG. 5 is a schematic illustration of the resulting appearance of the printed security feature of FIG. 1, when subjected to the non-visible light (e.g. ultraviolet) excitation.
Figure 10:
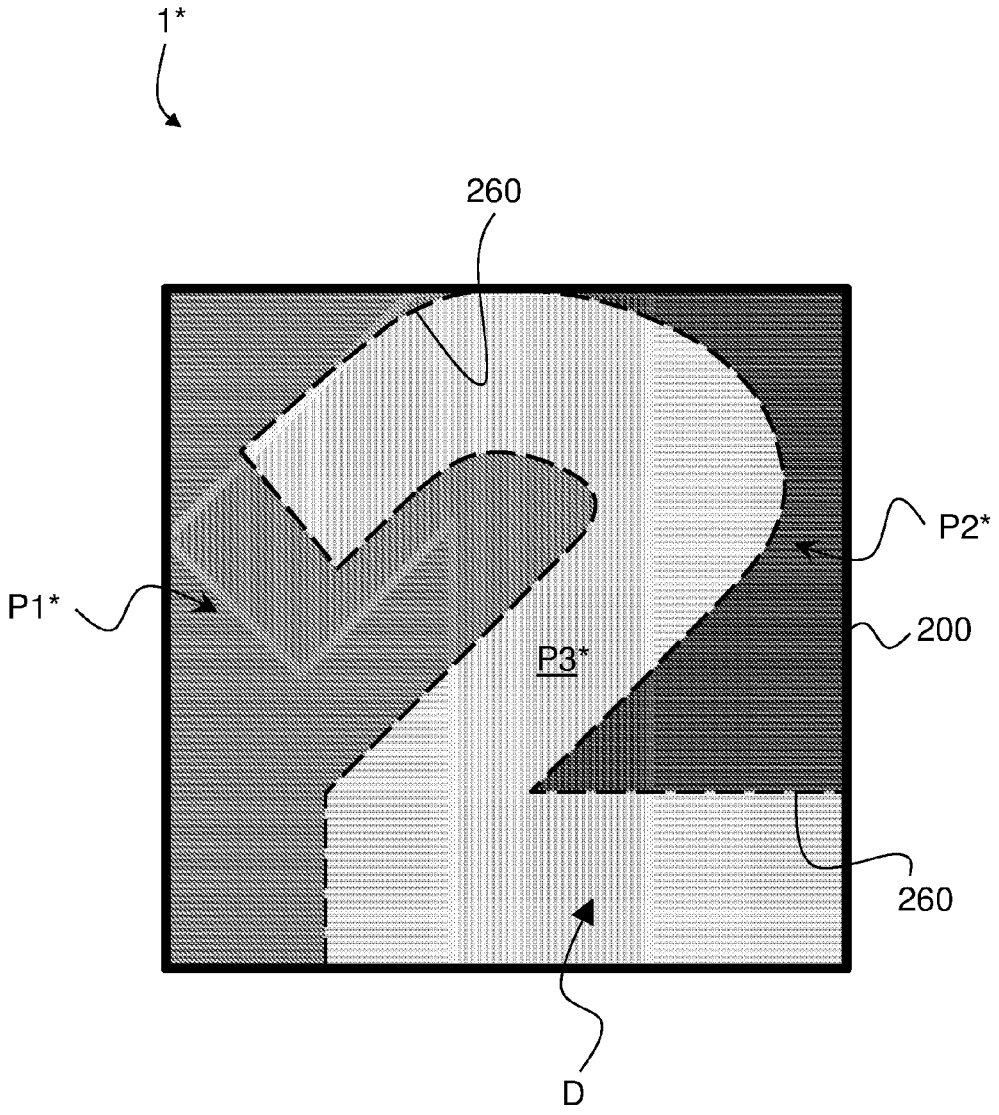
FIG. 10 is a schematic illustration of the resulting appearance of the printed security feature of FIG. 6, when subjected to the non-visible light (e.g. ultraviolet) excitation.

FIGS. 5 and 10 are schematic illustrations showing the resulting graphical representation when the printed security feature 1, respectively 1*, is illuminated with non-visible light (i.e. ultraviolet light).

In the aforementioned embodiments, a ratio of a surface of the first juxtaposed sections 110*a*, 120*a*, respectively 210*a*, 220*a*, over a surface of the second juxtaposed sections 110*b*, 120*b*, respectively 210*b*, 220*b*, inside the boundaries 160, respectively 260, of the two-dimensional graphic element B, respectively D, is substantially equal to 1. In other words, in the illustrations of FIGS. 3A-3B and 8A-8C, the line width of each juxtaposed section is approximately half (i.e. w/2) that of the overall line width w of the rectilinear elements. This ratio can be changed if required. This ratio preferably lies within a range of ½ to 2, which provides flexibility to modulate the respective contributions of the first and second fluorescent inks used in the aforementioned preferred embodiments, thereby allowing an adjustment of the third fluorescent colour resulting from additive mixture of the first and second fluorescent colours.

Printing of the adjacent rectilinear (and/or curvilinear elements as the case may be) is preferably carried out by Simultan-offset, namely by inking first and second offset printing plates with the first and second inks, respectively, and by transferring the resulting first and second ink patterns from the first and second offset printing plates onto a common blanket cylinder prior to printing. Other printing processes could be contemplated (such as intaglio printing) provided the printing process is adapted to print the multiplicity of adjacent rectilinear and/or curvilinear elements with an adequate register between the first and second inks. A suitable Simultan-offset printing press is for instance disclosed in European Patent Publication No. EP 0 949 069 A1, which is incorporated herein by reference. The aforementioned security features 1, respectively 1*, can conveniently be printed on one or the other side of a sheet (or any other suitable substrate) using two of the four plate cylinders that cooperate with one or the other blanket cylinder of the main printing group of the printing press of EP 0 949 069 A1 (see FIG. 1 thereof where reference numerals 4 to 7, respectively 8 to 11, designate relevant plate cylinders cooperating with a common blanket cylinder 2, respectively 3). Alternatively, the aforementioned security features 1, respectively 1*, could also be printed on one side of the sheet using the two plate cylinders that cooperate with the blanket cylinder of the additional printing group of the printing press of EP 0 949 069 A1 (see FIG. 1 thereof where reference numerals 23 and 24 designate relevant plate cylinders cooperating with a common blanket cylinder 22).

Variants of the aforementioned embodiments are possible. One could in particular contemplate to further print the rectilinear and/or curvilinear elements with at least third and fourth inks (in addition to the first and second inks), which third and fourth inks exhibit the same or substantially the same optical appearance when illuminated with visible white light, which optical appearance of the third and fourth inks is different from the optical appearance of the first and second inks. In this context, the third ink is an ink which also responds to non-visible light excitation by producing a characteristic optical response differentiating the third ink from the fourth ink, which characteristic optical response of the third ink is the same or substantially the same as the characteristic optical response of the first ink. Like the first and second inks, the third and fourth inks are also printed in register one with respect to the other so that the boundaries of the distinctive two-dimensional graphic element remain invisible when the printed security feature is illuminated with visible white light and the distinctive two-dimensional graphic element only becomes visible when the printed security feature is illuminated with non-visible light.

Illustrative examples of such variants are shown in FIGS. 11 to 13 and 14 to 16 and are briefly discussed hereinafter.

Figure 11:
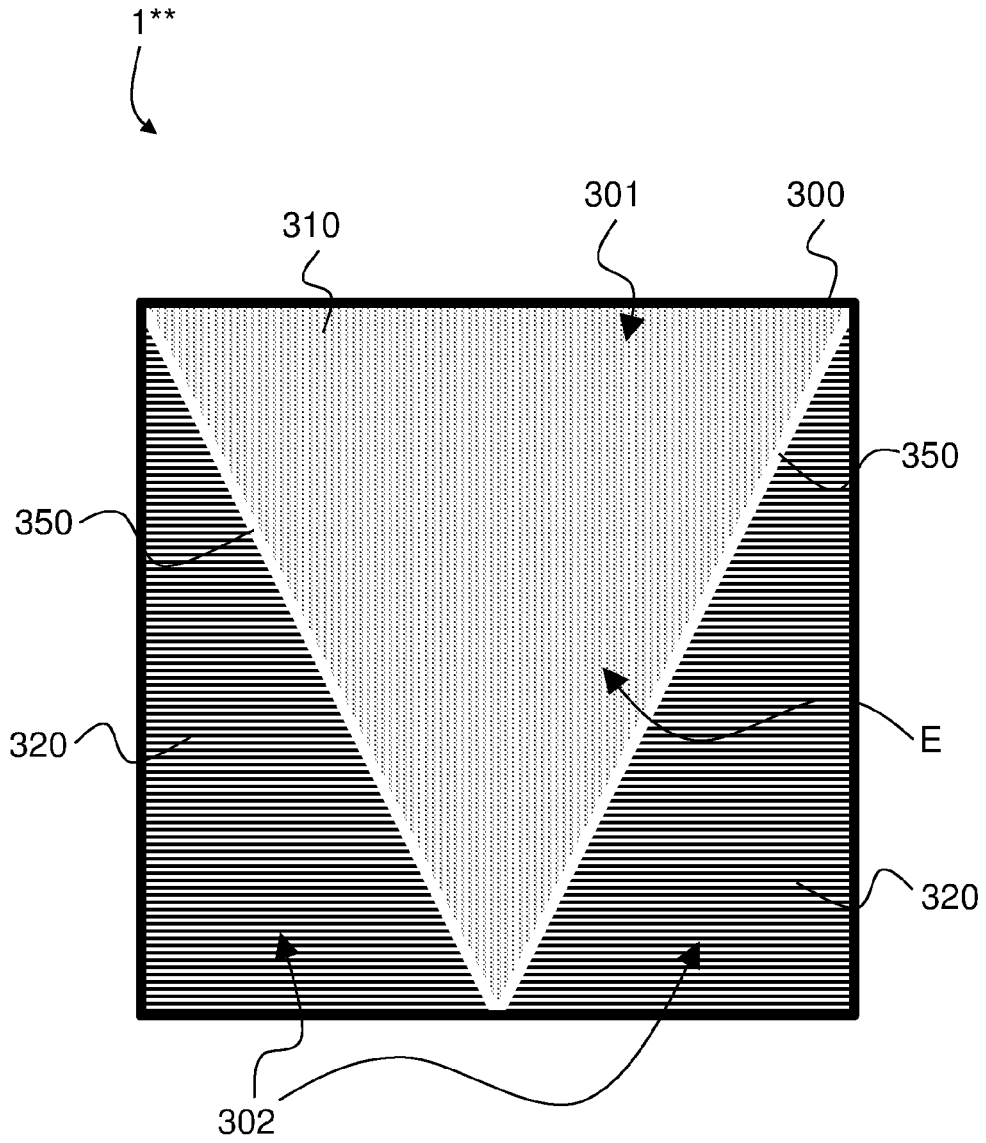
FIG. 11 is a schematic view of a variant of the printed security feature of FIG. 1 illustrating the printed security feature when illuminated with visible white light, which variant is printed using four different inks.
Figure 12:
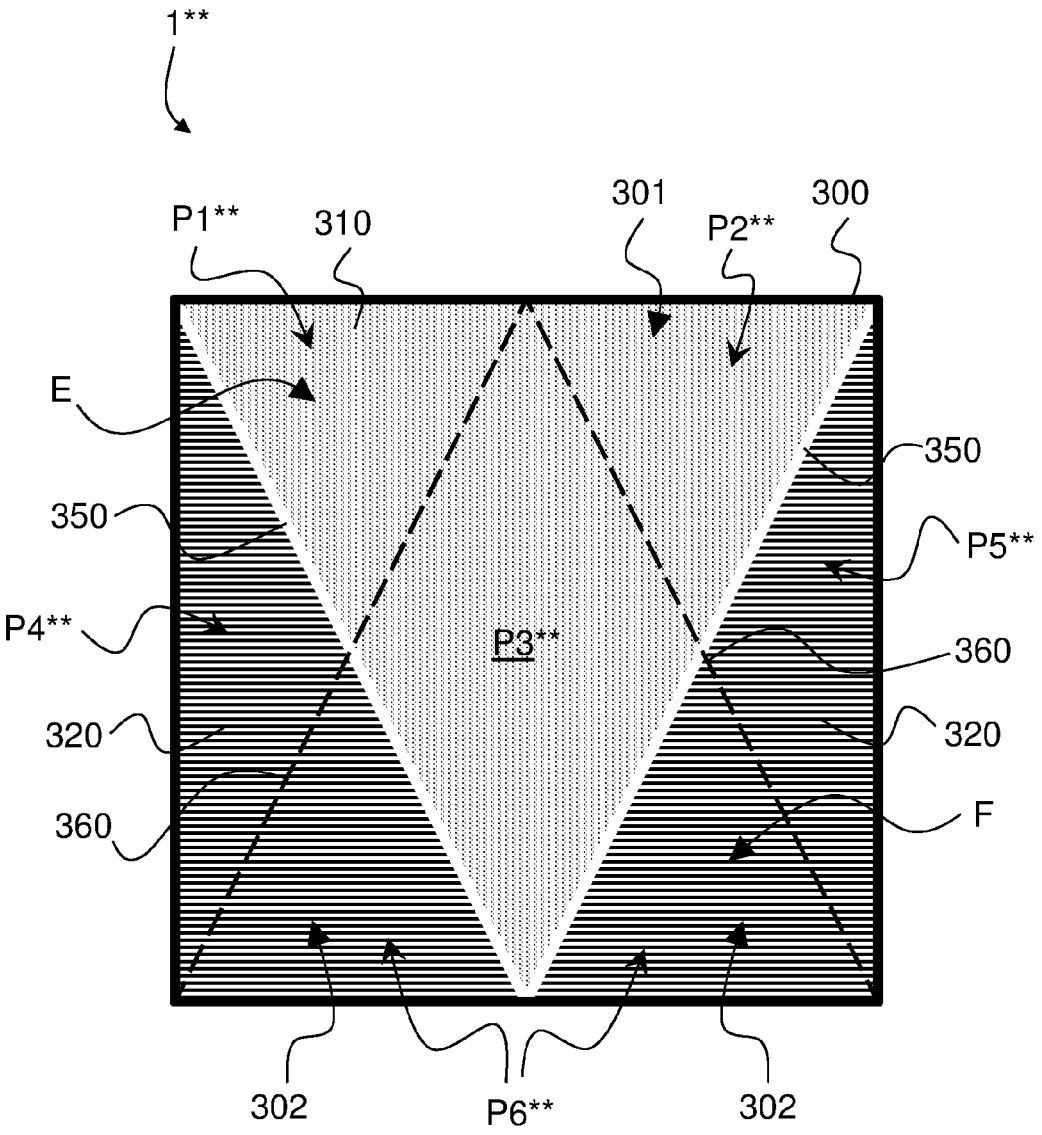
FIG. 12 is a schematic view of the printed security feature of FIG. 11 where boundaries of a distinctive two-dimensional graphic element (which element is designated generally by reference F) are shown in dashed lines, this distinctive two-dimensional graphic element being revealed only when the printed feature is illuminated with non-visible light (e.g. ultraviolet light), in the same way as in the first embodiment.
Figure 13:
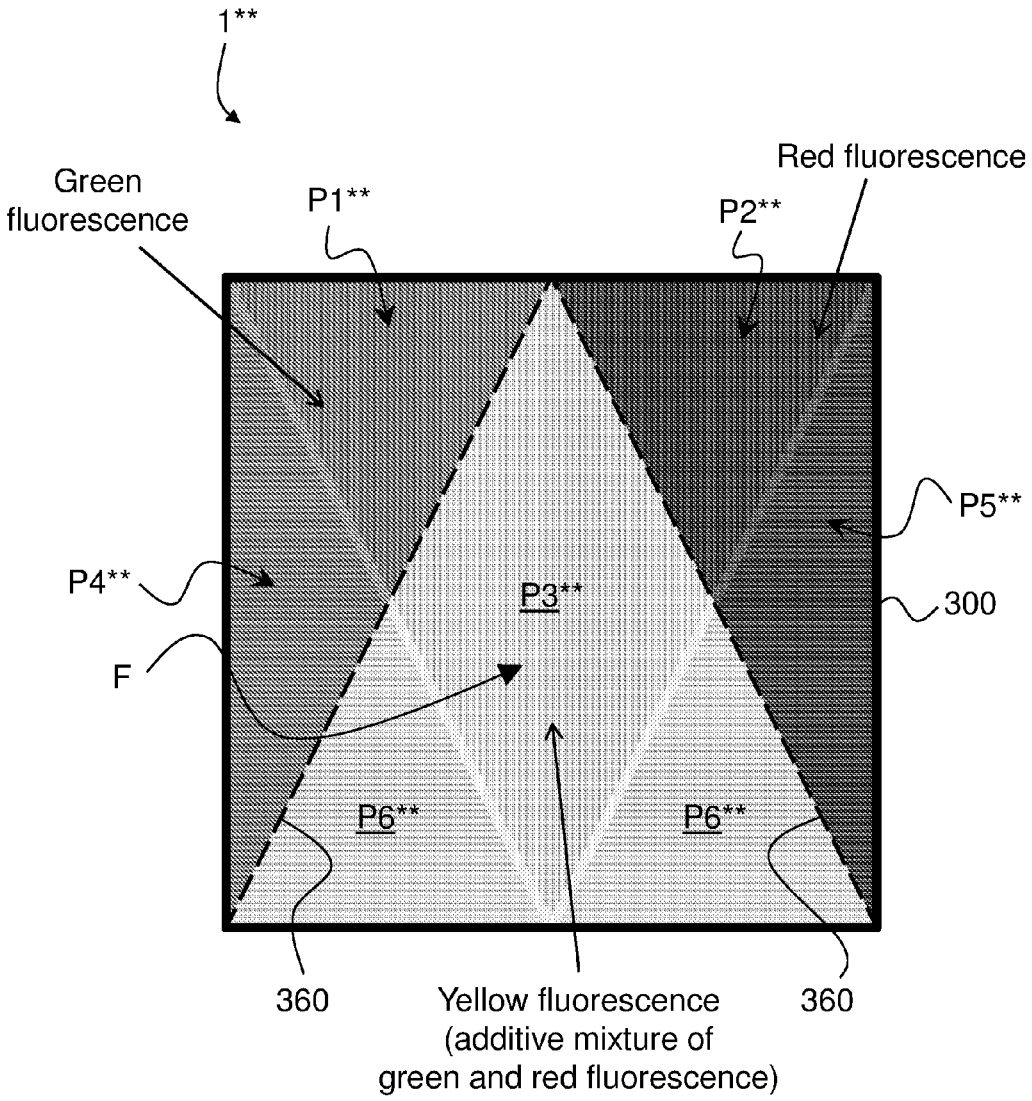
FIG. 13 is a schematic illustration of the resulting appearance of the printed security feature of FIG. 11, when subjected to the non-visible light (e.g. ultraviolet) excitation, which appearance is similar to that shown in FIG. 5.

FIGS. 11 to 13 illustrate a variant of the first embodiment of FIGS. 1 to 5, where the printed security feature, designated by reference numeral 1**, is printed using four inks as generally defined above. In this particular example, first and second inks are used which have the same properties as in the first embodiment, namely first and second fluorescent inks which produce corresponding visible responses when subjected to non-visible light excitation, the first and second inks producing distinct visible responses having respectively first and second fluorescent colours which are different from one another. Like in the first embodiment, the first fluorescent ink is an ink that fluoresces a green colour, while the second fluorescent ink is an ink that fluoresces a red colour. These examples are again purely illustrative and other fluorescent colours could be contemplated without departing from the scope of the invention as defined by the claims. In this example also, the first and second inks exhibit the same or substantially the same optical appearance when illuminated with visible white light.

In contrast to the first embodiment, third and fourth inks are further used to print the security feature 1**, namely third and fourth inks that exhibit the same or substantially the same optical appearance, but which is different from the optical appearance of the first and second inks. In this particular example, the third and fourth inks are also preferably third and fourth fluorescent inks which produce corresponding visible responses when subjected to non-visible light excitation, the third and fourth inks producing distinct visible responses. The fluorescent colour produced by the third fluorescent ink is selected to be the same or substantially the same as the first fluorescent colour of the first fluorescent ink (i.e. a green colour in this case). In contrast, the fluorescent colour produced by the fourth fluorescent ink is selected to be the same or substantially the same as the second fluorescent colour of the second fluorescent ink (i.e. a red colour in this case).

Much like in the first embodiment of FIGS. 1 to 5, the printed security feature 1 of FIGS. 11 to 13 is characterized by the fact that the first graphical representation of the printed security feature (under visible light) exhibits a first two-dimensional graphic element E (namely a triangular shape pointing downwards) which is distinguishable from the distinctive two-dimensional graphic element F (namely a triangular shape pointing upwards) that becomes visible when the printed security feature is illuminated with non-visible light, the first two-dimensional graphic element E and the distinctive two-dimensional graphic element F being positioned in a partially overlapping manner within the printed area of the security feature 1** (see FIG. 12), which printed area is designated by reference numeral 300 in FIGS. 11 to 13. Boundaries of the distinctive two-dimensional graphic element F are depicted by dashed lines in FIGS. 12 and 13 and are designated by reference numeral 360. In the example of FIGS. 11 to 13**, the first two-dimensional graphic element E and the distinctive two-dimensional graphic element F likewise have identical shapes (i.e. a triangular shape in the illustrated example) and are designed in such a way that commutation between the first two-dimensional graphic element E and the distinctive two-dimensional graphic element F gives the impression of a flip or movement of a same graphic element from one position to another (namely a triangular shape pointing downwards or upwards).

In this variant, the printed area 300 consists of a multiplicity of parallel rectilinear elements designated by reference numerals 310, 320 in FIGS. 11 and 12. The geometrical and spatial arrangement of the rectilinear elements 310, 320 is identical to that of the rectilinear elements 110, 120 of the first embodiment. In other words, the multiplicity of parallel rectilinear elements 310, 320 include a first set of rectilinear elements 310 extending over a first zone 301 of the printed area 300 and at least a second set of rectilinear elements 320 extending over a second zone 302 of the printed area 300. The first and second sets 310, 320 of rectilinear elements are likewise separated by an unprinted borderline designated by reference numeral 350, but this borderline 350 could be omitted. The orientations of the rectilinear elements 310, 320 are the same as that of the rectilinear elements 110, 120 of the first embodiment, but this is not essential.

In contrast to the first embodiment, the first graphical representation E is enhanced by the use of inks having different optical appearances when illuminated by visible light, namely the first and second inks, on the one hand, and the third and fourth inks, on the other hand. More precisely, the first zone 301 consists of rectilinear elements 310 that are printed using the first and second inks, while the second zone 302 consists of rectilinear elements 320 that are printed using the third and fourth inks. The first and second zones 301, 302 are therefore clearly differentiable due to the different optical appearances of the first and second inks compared to the third and fourth inks.

The portion P3 of the rectilinear elements 310, within the boundaries 360 of the distinctive two-dimensional graphic element F, is printed with a combination of the first and second inks like in the first embodiment. Similarly, the portions P1**, P2** of the rectilinear elements 310, outside the boundaries 360 of the distinctive two-dimensional graphic element F, are printed with either the first or the second ink. By the same token, the two portions P6** of the rectilinear elements 320, within the boundaries 360 of the distinctive two-dimensional graphic element F, are printed with a combination of the third and fourth inks. Similarly, the portions P4**, P5** of the rectilinear elements 320, outside the boundaries 360** of the distinctive two-dimensional graphic element F, are printed with either the third or fourth ink.

The rectilinear elements 310, 320 are printed, inside the boundaries 360, along the same principle as already described with reference to FIGS. 3A and 3B, with the difference that the rectilinear elements 310 are subdivided (in portion P3) into first and second juxtaposed sections which are printed with a combination of the first and second inks, while the rectilinear elements 320 are subdivided (in portion P6****) into first and second juxtaposed sections which are printed with a combination of the third and fourth inks. The same rules as described above in connection with the previous embodiments apply, including the comments regarding line width w and line frequency.

In this example, the triangular portion of the rectilinear elements 320 on the left-hand side of the printed area 300, outside of the boundaries 360, (i.e. portion P4) is printed exclusively with the third ink, such as to jointly form, together with the triangular portion P1** of the rectilinear elements 310 which is printed exclusively with the first ink, a triangular portion that fluoresces in green colour when illuminated with non-visible light (i.e. ultraviolet light) like in the embodiment of FIGS. 1 to 5. Likewise, the triangular portion P5** of the rectilinear elements 320 on the right-hand side of the printed area 300 is printed exclusively with the fourth ink, such as to jointly form, together with the triangular portion P2** of the rectilinear elements 310 which is printed exclusively with the second ink, a triangular portion that fluoresces in red colour when illuminated with non-visible light (i.e. ultraviolet light) like in the embodiment of FIGS. 1 to 5**.

Within the boundaries 360 of the distinctive two-dimensional graphic element F, the combination of the first and second inks (in portion P3), on the one hand, and the combination of third and fourth inks (in portions P6****), on the other hand, both lead to the formation a readily recognizable triangular element F that fluoresces in yellow colour due to the additive mixture of the fluorescent green and red colours.

Figure 14:
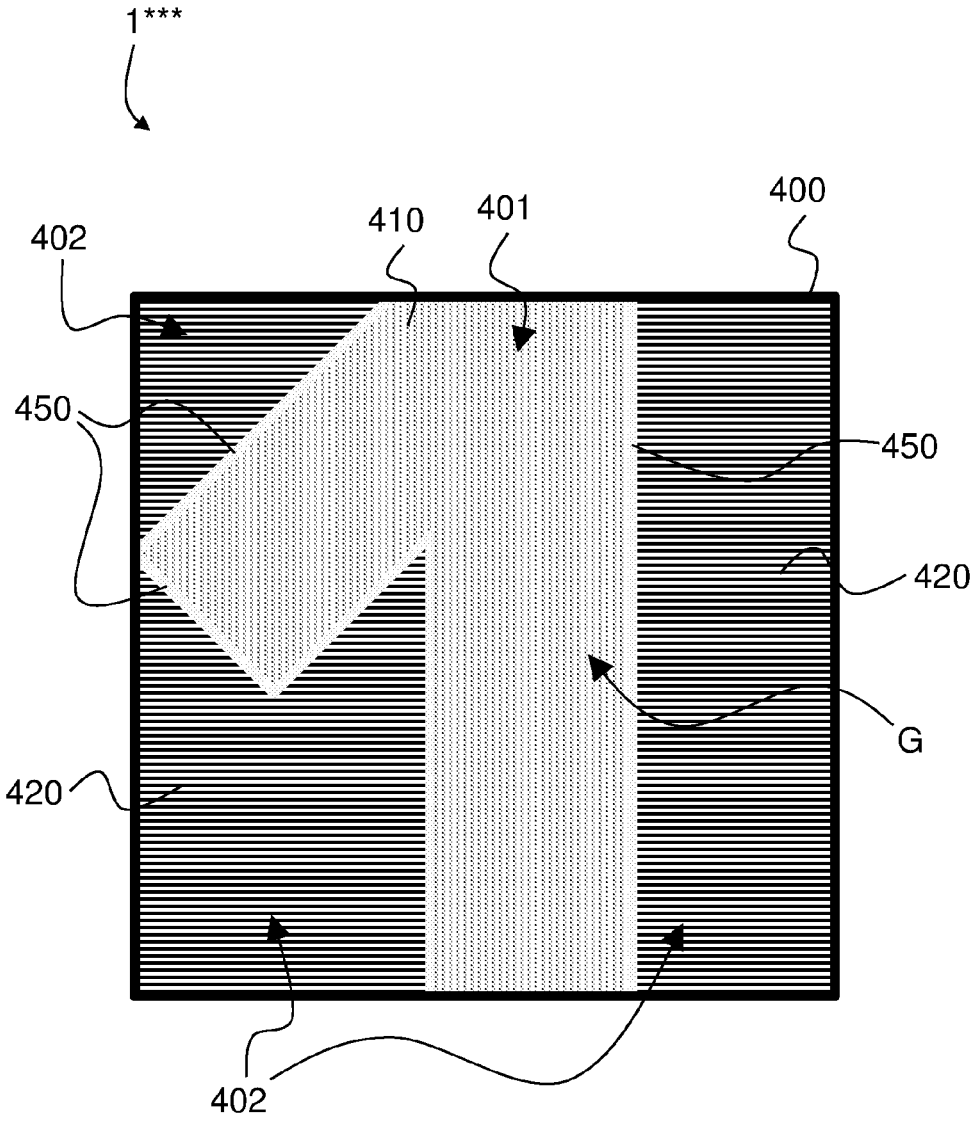
FIG. 14 is a schematic view of a variant of the printed security feature of FIG. 6 illustrating the printed security feature when illuminated with visible white light, which variant is printed using four different inks.
Figure 15:
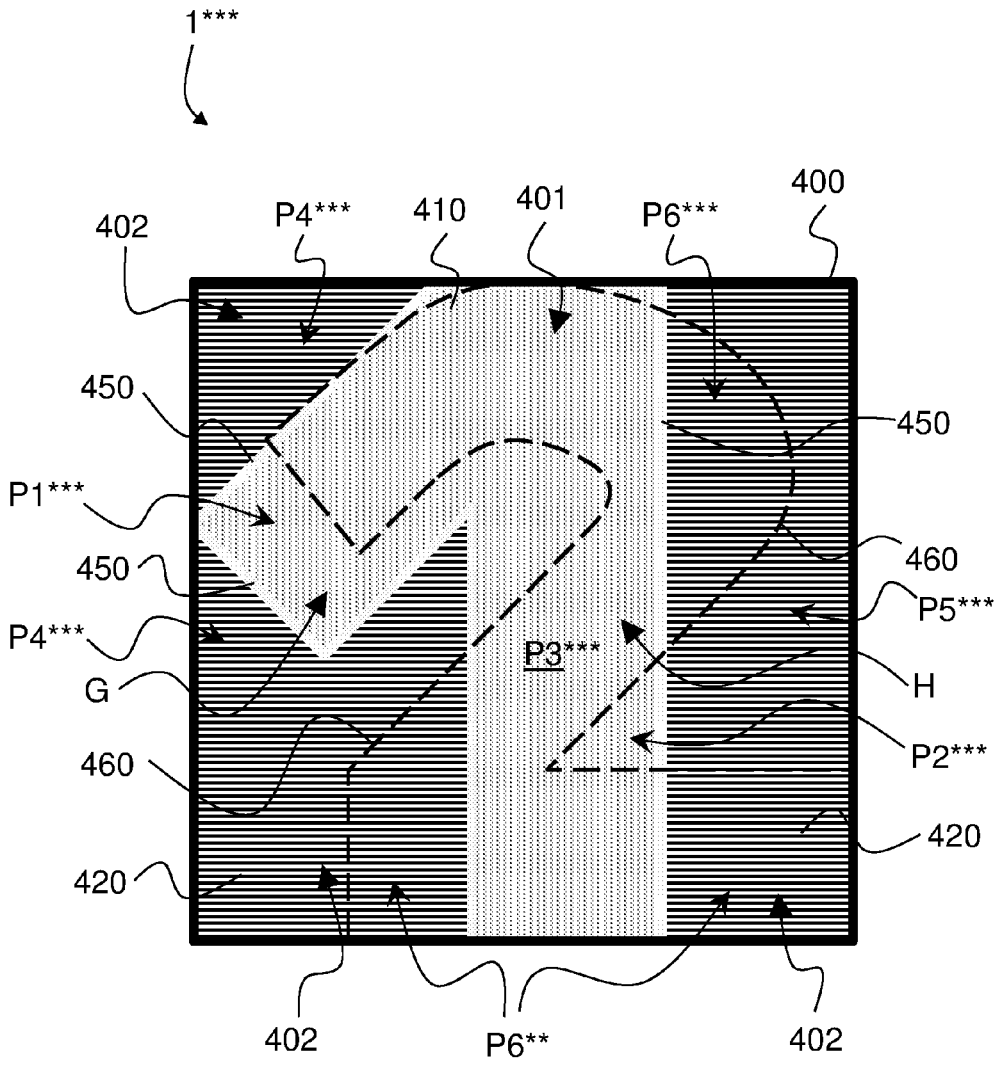
FIG. 15 is a schematic view of the printed security feature of FIG. 14 where boundaries of a distinctive two-dimensional graphic element (which element is designated generally by reference H) are shown in dashed lines, this distinctive two-dimensional graphic element being revealed only when the printed feature is illuminated with non-visible light (e.g. ultraviolet light), in the same way as in the second embodiment.
Figure 16:
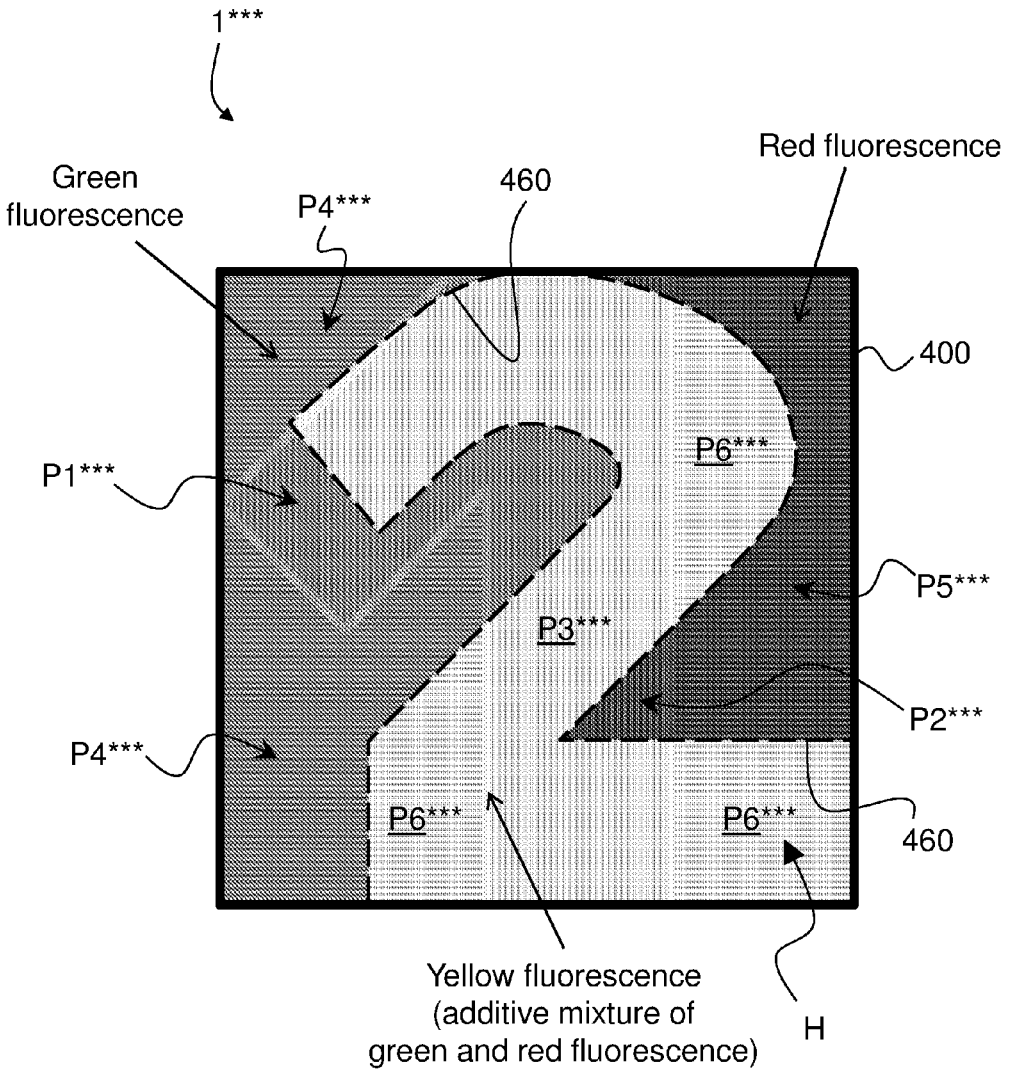
FIG. 16 is a schematic illustration of the resulting appearance of the printed security feature of FIG. 6, when subjected to the non-visible light (e.g. ultraviolet) excitation, which appearance is similar to that shown in FIG. 10.

FIGS. 14 to 16 illustrate a variant of the second embodiment of FIGS. 6 to 10, where the printed security feature, designated by reference numeral 1***, is printed using four inks as generally defined above. In this particular example, first and second inks are used which have the same properties as in the second embodiment, namely first and second fluorescent inks which produce corresponding visible responses when subjected to non-visible light excitation, the first and second inks producing distinct visible responses having respectively first and second fluorescent colours which are different from one another. Like in the second embodiment, the first fluorescent ink is an ink that fluoresces a green colour, while the second fluorescent ink is an ink that fluoresces a red colour. These examples are once again purely illustrative and other fluorescent colours could be contemplated without departing from the scope of the invention as defined by the claims. In this example also, the first and second inks exhibit the same or substantially the same optical appearance when illuminated with visible white light.

In contrast to the second embodiment, third and fourth inks are further used to print the security feature 1***, namely third and fourth inks that exhibit the same or substantially the same optical appearance, but which is different from the optical appearance of the first and second inks. In this particular example, the third and fourth inks are also preferably third and fourth fluorescent inks which produce corresponding visible responses when subjected to non-visible light excitation, the third and fourth inks producing distinct visible responses. The fluorescent colour produced by the third fluorescent ink is again selected to be the same or substantially the same as the first fluorescent colour of the first fluorescent ink (i.e. a green colour in this case). Likewise, the fluorescent colour produced by the fourth fluorescent ink is again selected to be the same or substantially the same as the second fluorescent colour of the second fluorescent ink (i.e. a red colour in this case).

Much like in the second embodiment of FIGS. 6 to 10, the printed security feature 1* of FIGS. 14 to 16 is characterized by the fact that the first graphical representation of the printed security feature (under visible light) exhibits a first two-dimensional graphic element G (namely the numerical symbol "1") which is distinguishable from the distinctive two-dimensional graphic element H (namely the numerical symbol "2") that becomes visible when the printed security feature is illuminated with non-visible light, the first two-dimensional graphic element G and the distinctive two-dimensional graphic element H being positioned in a partially overlapping manner within the printed area of the security feature 1*** (see FIG. 15), which printed area is designated by reference numeral 400 in FIGS. 14 to 16. Boundaries of the distinctive two-dimensional graphic element H are depicted by dashed lines in FIGS. 15 and 16 and are designated by reference numeral 460. In the example of FIGS. 14 to 16, the first two-dimensional graphic element G and the distinctive two-dimensional graphic element H likewise have different shapes each providing recognizable information (i.e. the numerical symbols "1" and "2" in the illustrated example) and are designed in such a way that commutation between the first two-dimensional graphic element G and the distinctive two-dimensional graphic element H leads to a recognizable change in information (namely a change between the numerical symbol "1" and the numerical symbol "2**").

In this variant, the printed area 400 consists of a multiplicity of parallel rectilinear elements designated by reference numerals 410, 420 in FIGS. 14 and 15. The geometrical and spatial arrangement of the rectilinear elements 410, 420 is identical to that of the rectilinear elements 210, 220 of the second embodiment. In other words, the multiplicity of parallel rectilinear elements 410, 420 include a first set of rectilinear elements 410 extending over a first zone 401 of the printed area 400 and at least a second set of rectilinear elements 420 extending over a second zone 402 of the printed area 400. The first and second sets 410, 420 of rectilinear elements are likewise separated by an unprinted borderline designated by reference numeral 450, but this borderline 450 could be omitted. The orientations of the rectilinear elements 410, 420 are the same as that of the rectilinear elements 210, 220 of the first embodiment, but this is again not essential.

In contrast to the second embodiment, the first graphical representation G is enhanced by the use of inks having different optical appearances when illuminated by visible light, namely the first and second inks, on the one hand, and the third and fourth inks, on the other hand. More precisely, the first zone 401 consists of rectilinear elements 410 that are printed using the first and second inks, while the second zone 402 consists of rectilinear elements 420 that are printed using the third and fourth inks. The first and second zones 401, 402 are therefore clearly differentiable due to the different optical appearances of the first and second inks compared to the third and fourth inks.

The portion P3* of the rectilinear elements 410, within the boundaries 460 of the distinctive two-dimensional graphic element H, is printed with a combination of the first and second inks like in the first embodiment. Similarly, the portions P1***, P2*** of the rectilinear elements 410, outside the boundaries 460 of the distinctive two-dimensional graphic element H, are printed with either the first or the second ink (note that, in the illustrated example, there are two further portions of the rectilinear elements 410 above the graphic element H). By the same token, the portions P6*** of the rectilinear elements 420, within the boundaries 460 of the distinctive two-dimensional graphic element H, are printed with a combination of the third and fourth inks. Similarly, the portions P4***, P5*** of the rectilinear elements 420, outside the boundaries 460** of the distinctive two-dimensional graphic element F, are printed with either the third or fourth ink.

The rectilinear elements 410, 420 are printed, inside the boundaries 460, along the same principle as already described with reference to FIG. 8A to 8C, with the difference that the rectilinear elements 410 are subdivided into first and second juxtaposed sections which are printed with a combination of the first and second inks, while the rectilinear elements 420 are subdivided into first and second juxtaposed sections which are printed with a combination of the third and fourth inks. Once again, the same rules as described above in connection with the previous embodiments apply, including the comments regarding line width w and line frequency.

In this example, the portions of the rectilinear elements 420 on the left-hand side of the printed area 400, outside of the boundaries 460, (i.e. portions P4*) are printed exclusively with the third ink, such as to jointly form, together with the corresponding portions P1*** of the rectilinear elements 410 which are printed exclusively with the first ink, a left portion that fluoresces in green colour when illuminated with non-visible light (i.e. ultraviolet light) like in the embodiment of FIGS. 6 to 10. Likewise, the portion P5*** of the rectilinear elements 420 on the right-hand side of the printed area 400, outside of the boundaries 460, is printed exclusively with the fourth ink, such as to jointly form, together with the corresponding portions P2*** of the rectilinear elements 410 which are printed exclusively with the second ink, a right portion that fluoresces in red colour when illuminated with non-visible light (i.e. ultraviolet light) like in the embodiment of FIGS. 6 to 10**.

Within the boundaries 460 of the distinctive two-dimensional graphic element H, the combination of the first and second inks (in portion P3*), on the one hand, and the combination of third and fourth inks (in portions P6***), on the other hand, both lead to the formation a readily recognizable element H forming the numerical symbol "2**" that fluoresces in yellow colour due to the additive mixture of the fluorescent green and red colours.

Various modifications and/or improvements may be made to the above-described embodiments without departing from the scope of the invention as defined by the annexed claims.

As already mentioned, within the scope of the present invention, the printed area can consist of a multiplicity of adjacent rectilinear and/or curvilinear elements printed with a given spatial frequency. The invention is not therefore limited to the illustrated examples where the printed area only consists of a multiplicity of adjacent rectilinear elements 110, 120, respectively 210, 220.

In addition, the juxtaposed sections could be adjacent line sections split along the width of the rectilinear and/or curvilinear elements as illustrated in FIGS. 3A-3B or 8A-8C or be a succession of adjacent line sections split along the length of the rectilinear and/or curvilinear elements.

In the above described embodiments, all the inks are fluorescent inks. It is however to be appreciated that only one fluorescent ink could be used (as the first ink or second ink) in the context of the embodiments of FIGS. 1 to 10. Likewise, it is to be appreciated that only two fluorescent inks producing the same or substantially the same fluorescent colour could be used (as the first and third inks or as the second and fourth inks) in the context of the embodiments of FIGS. 11 to 16. Furthermore, the fluorescent ink(s) may be responsive to any suitable non-visible light excitation, such as ultraviolet excitation, near-infrared excitation, or any other suitable excitation outside of the visible spectrum.

LIST OF REFERENCE NUMERALS USED THEREIN

Figure 6:
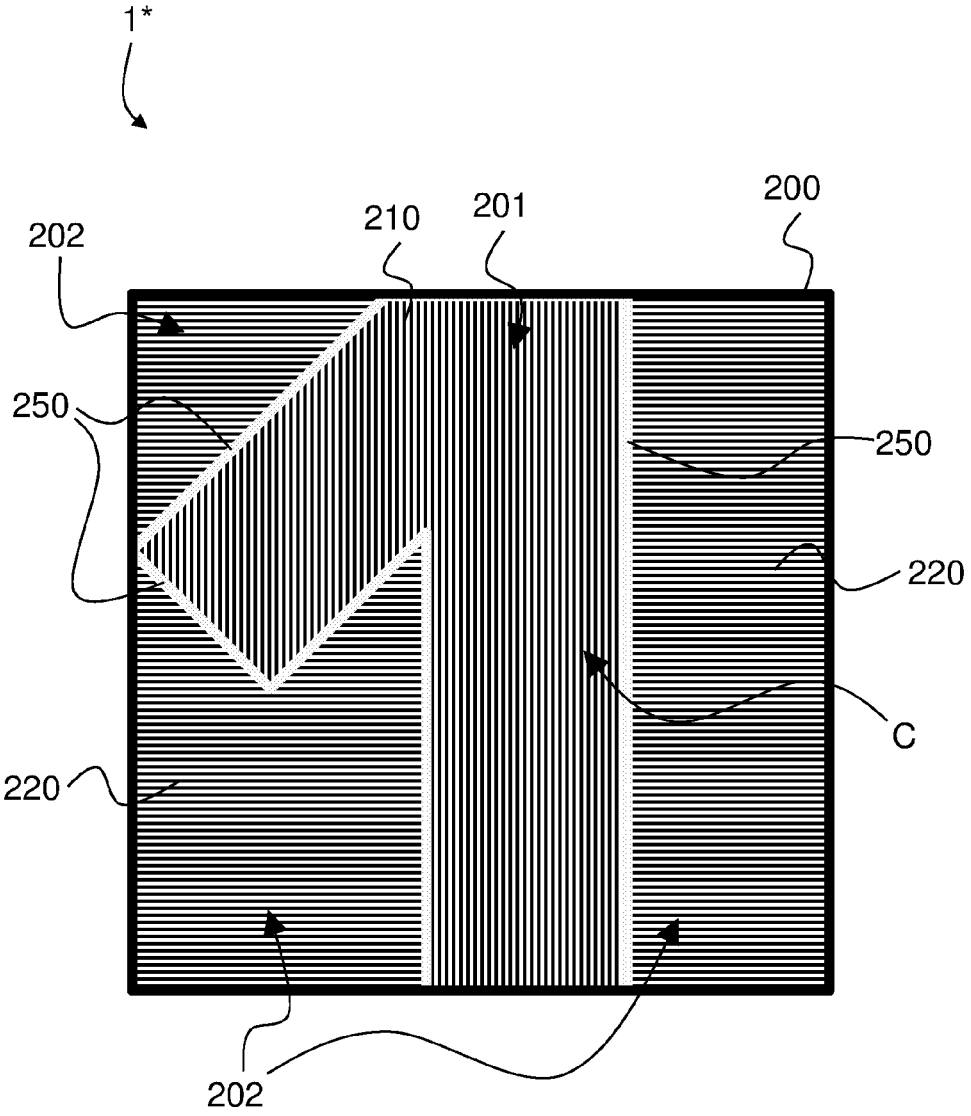
FIG. 6 is a schematic view of a printed security feature in accordance with a second embodiment of the invention, FIG. 6 illustrating the printed security feature when illuminated with visible white light.
Figure 7:
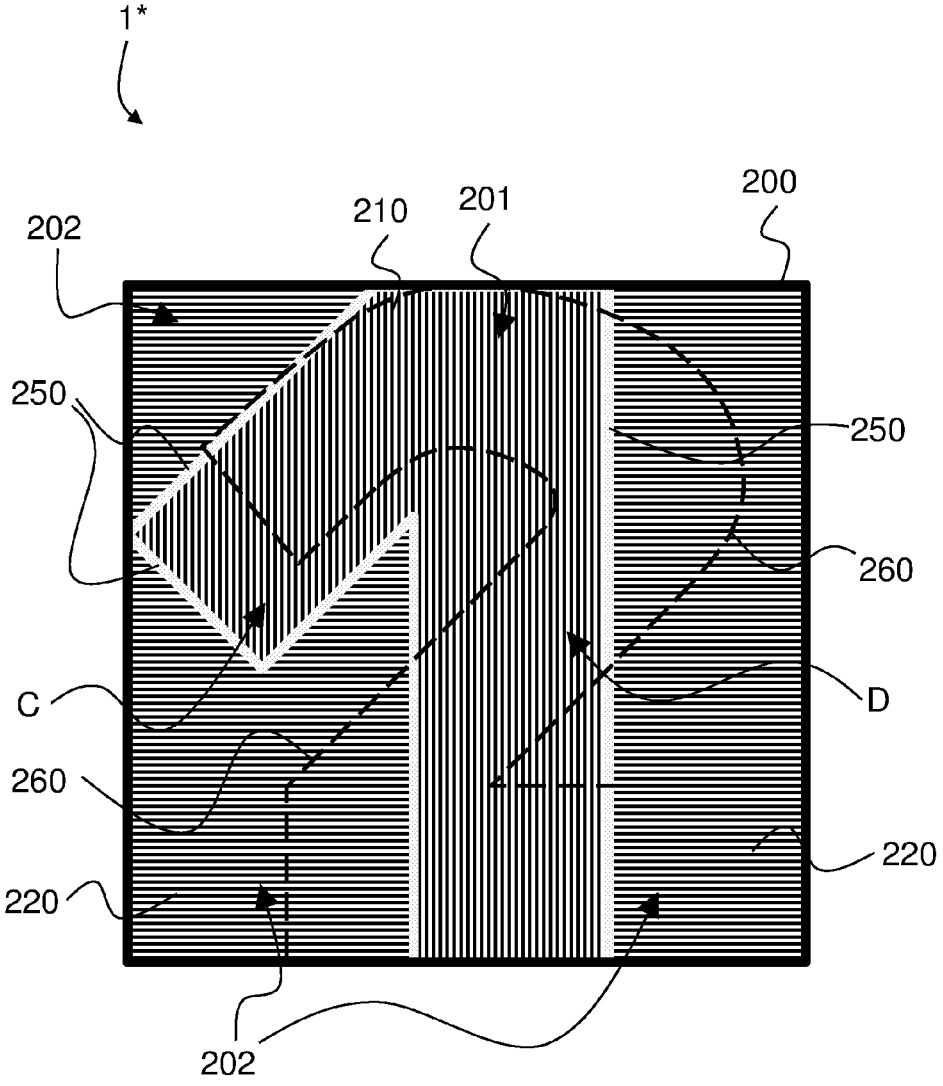
FIG. 7 is a schematic view of the printed security feature of FIG. 6 where boundaries of a distinctive two-dimensional graphic element (which element is designated generally by reference D) are shown in dashed lines, this distinctive two-dimensional graphic element being revealed only when the printed feature is illuminated with non-visible light (e.g. ultraviolet light)

1 printed security feature (first embodiment—FIGS. 1 to 5)
100 printed area (first embodiment)
101 first zone of printed area 100/triangular area pointing downward from the upper edge of printed area 100 in FIG. 1
102 second zone of printed area 100/triangular areas located on each side of the triangular area 101 in FIG. 1
A (first) two-dimensional graphic element (e.g. triangular shape pointing downwards) visible when the printed security feature 1 is illuminated with visible white light (FIG. 1)
B (second) distinctive two-dimensional graphic element (e.g. triangular shape pointing upwards) which becomes visible when the printed security feature 1 is illuminated with non-visible light (FIGS. 4, 5)
110 adjacent rectilinear (and/or curvilinear) elements/parallel rectilinear elements extending over first zone 101/lines extending along a first (e.g. vertical) orientation
110*a* first (juxtaposed) section of rectilinear elements 110, inside the boundaries 160 of the distinctive two-dimensional graphic element B, which is printed with a first ink that is responsive to non-visible light excitation by producing a characteristic optical response/e.g. (first) fluorescent ink producing a (first) fluorescent (e.g. green) colour when subjected to the non-visible light excitation (e.g. ultraviolet excitation)
110*b* second (juxtaposed) section of rectilinear elements 110, inside the boundaries 160 of the distinctive two-dimensional graphic element B, which is printed with a second ink/e.g. (second) fluorescent ink producing a (second) fluorescent (e.g. red) colour when subjected to the non-visible light excitation (e.g. ultraviolet excitation)
120 adjacent rectilinear (and/or curvilinear) elements/parallel rectilinear elements extending over second zone 102/lines extending along a second (e.g. horizontal) orientation
120*a* first (juxtaposed) section of rectilinear elements 120, inside the boundaries 160 of the distinctive two-dimensional graphic element B, which is printed with the first ink (same ink as 110*a*)
120*b* second (juxtaposed) section of rectilinear elements 120, inside the boundaries 160 of the distinctive two-dimensional graphic element B, which is printed with the second ink (same ink as 110*b*)
150 unprinted borderline between first and second zones 101, 102
160 boundaries of two-dimensional graphic element B (not visible when illuminated with visible white light)
P1 portion(s) of elements 110, 120 printed exclusively with the first (fluorescent) ink
P2 portion(s) of elements 110, 120 printed exclusively with the second (fluorescent) ink
P3 portion(s) of elements 110, 120 printed with a combination of the first and second (fluorescent) inks
1* printed security feature (second embodiment—FIGS. 6 to 10)
200 printed area (second embodiment)
201 first zone of printed area 200/area forming numerical symbol "1" in FIG. 6
202 second zone of printed area 200/background area surrounding the numerical symbol "1" in FIG. 6
C (first) two-dimensional graphic element (e.g. numerical symbol "1") visible when the printed security feature 1* is illuminated with visible white light (FIG. 6)

D (second) distinctive two-dimensional graphic element (e.g. numerical symbol "2") which becomes visible when the printed security feature 1* is illuminated with non-visible light (FIGS. 9, 10)

210 adjacent rectilinear (and/or curvilinear) elements/parallel rectilinear elements extending over first zone 201/lines extending along a first (e.g. vertical) orientation

210*a* first (juxtaposed) section of rectilinear elements 210, inside the boundaries 260 of the distinctive two-dimensional graphic element D, which is printed with a first ink that is responsive to non-visible light excitation by producing a characteristic optical response/e.g. (first) fluorescent ink producing a (first) fluorescent (e.g. green) colour when subjected to the non-visible light excitation (e.g. ultraviolet excitation)

210*b* second (juxtaposed) section of rectilinear elements 210, inside the boundaries 260 of the distinctive two-dimensional graphic element D, which is printed with a second ink/e.g. (second) fluorescent ink producing a (second) fluorescent (e.g. red) colour when subjected to the non-visible light excitation (e.g. ultraviolet excitation)

220 adjacent rectilinear (and/or curvilinear) elements/parallel rectilinear elements extending over second zone 202/lines extending along a second (e.g. horizontal) orientation

220*a* first (juxtaposed) section of rectilinear elements 220, inside the boundaries 260 of the distinctive two-dimensional graphic element D, which is printed with the first ink (same ink as 210*a*)

220*b* second (juxtaposed) section of rectilinear elements 120, inside the boundaries 260 of the distinctive two-dimensional graphic element D, which is printed with the second ink (same ink as 210*b*)

250 unprinted borderline between first and second zones 201, 202

260 boundaries of two-dimensional graphic element D (not visible when illuminated with visible white light)

P1* portion(s) of elements 210, 220 printed exclusively with the first (fluorescent) ink P2* portion(s) of elements 210, 220 printed exclusively with the second (fluorescent) ink P3* portion(s) of elements 210, 220 printed with a combination of the first and second (fluorescent) inks w line width of rectilinear elements 110, 120, 210, 220/combined line width of first and second juxtaposed sections 110*a*+110*b*, 120*a*+120*b*, 210*a*+210*b*, and 220*a*+220*b*

1 printed security feature (variant of first embodiment—FIGS. 11-13**)

300 printed area (variant of first embodiment)

301 first zone of printed area 300/triangular area pointing downward from the upper edge of printed area 300 in FIG. 11

302 second zone of printed area 300/triangular areas located on each side of the triangular area 301 in FIG. 11

E (first) two-dimensional graphic element (e.g. triangular shape pointing downwards) visible when the printed security feature 1 is illuminated with visible white light (FIG. 11**)

F (second) distinctive two-dimensional graphic element (e.g. triangular shape pointing upwards) which becomes visible when the printed security feature 1 is illuminated with non-visible light (FIG. 13**)

310 adjacent rectilinear (and/or curvilinear) elements/parallel rectilinear elements extending over first zone 301/lines extending along a first (e.g. vertical) orientation

320 adjacent rectilinear (and/or curvilinear) elements/parallel rectilinear elements extending over second zone 302/lines extending along a second (e.g. horizontal) orientation

350 unprinted borderline between first and second zones 301, 302

360 boundaries of two-dimensional graphic element F (not visible when illuminated with visible white light)

P1 portion(s) of elements 310 printed exclusively with the first (fluorescent) ink P2** portion(s) of elements 310 printed exclusively with the second (fluorescent) ink P3** portion(s) of elements 310 printed with a combination of the first and second (fluorescent) inks P4** portion(s) of elements 320 printed exclusively with the third (fluorescent) ink P5** portion(s) of elements 320 printed exclusively with the fourth (fluorescent) ink P6** portion(s) of elements 320** printed with a combination of the third and fourth (fluorescent) inks

1* printed security feature (variant of second embodiment—FIGS. 14-16**)

400 printed area (variant of second embodiment)

401 first zone of printed area 400/area forming numerical symbol "1" in FIG. 14

402 second zone of printed area 400/background area surrounding the numerical symbol "1" in FIG. 14

G (first) two-dimensional graphic element (e.g. numerical symbol "1") visible when the printed security feature 1* is illuminated with visible white light (FIG. 11**)

H (second) distinctive two-dimensional graphic element (e.g. numerical symbol "2") which becomes visible when the printed security feature 1* is illuminated with non-visible light (FIG. 16**)

410 adjacent rectilinear (and/or curvilinear) elements/parallel rectilinear elements extending over first zone 401/lines extending along a first (e.g. vertical) orientation

420 adjacent rectilinear (and/or curvilinear) elements/parallel rectilinear elements extending over second zone 402/lines extending along a second (e.g. horizontal) orientation

450 unprinted borderline between first and second zones 401, 402

460 boundaries of two-dimensional graphic element H (not visible when illuminated with visible white light)

P1* portion(s) of elements 410 printed exclusively with the first (fluorescent) ink P2* portion(s) of elements 410 printed exclusively with the second (fluorescent) ink P3*** portion(s) of elements 410 printed with a combination of the first and second (fluorescent) inks P4*** portion(s) of elements 420 printed exclusively with the third (fluorescent) ink P5*** portion(s) of elements 420 printed exclusively with the fourth (fluorescent) ink P6** portion(s) of elements 420** printed with a combination of the third and fourth (fluorescent) inks

The invention claimed is:

1. A printed security feature provided onto a printable substrate, which printed security feature includes a printed area consisting of a multiplicity of adjacent rectilinear and/or curvilinear elements printed with a given spatial frequency, wherein the rectilinear and/or curvilinear elements are printed with at least first and second inks which exhibit the same or substantially the same optical appearance when illuminated with visible white light, such that the printed security feature produces a first graphical representation when illuminated with visible white light, at least the first ink being an ink which responds to non-visible light excitation by producing a characteristic optical response differentiating the first ink from the second ink, wherein the printed security feature produces a second graphical representation when illuminated with non-visible light, which second graphical representation exhibits a distinctive two-dimensional graphic element which is revealed only when the printed security feature is illuminated with non-visible light, wherein, inside boundaries of the distinctive two-dimensional graphic element, a part of the rectilinear and/or curvilinear elements is printed with a combination of the first and second inks, the rectilinear and/or curvilinear elements being subdivided, within said part, into first and second juxtaposed sections, the first juxtaposed sections being printed with the first ink and the second juxtaposed sections being printed with the second ink, wherein, outside the boundaries of the distinctive two-dimensional graphic element, portions of the rectilinear and/or curvilinear elements are printed with only one of the at least first and second inks, the at least first and second inks being printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

2. The printed security feature according to claim 1, wherein, outside the boundaries of the distinctive two-dimensional graphic element, a first portion of the rectilinear and/or curvilinear elements is printed only with the first ink and a second portion of the rectilinear and/or curvilinear elements is printed only with the second ink.

3. The printed security feature according to claim 2, wherein the rectilinear and/or curvilinear elements are further printed with at least third and fourth inks which exhibit the same or substantially the same optical appearance when illuminated with visible white light, which optical appearance of the third and fourth inks is different from the optical appearance of the first and second inks, wherein the third ink is an ink which responds to non-visible light excitation by producing a characteristic optical response differentiating the third ink from the fourth ink, which characteristic optical response of the third ink is the same or substantially the same as the characteristic optical response of the first ink, wherein, inside the boundaries of the distinctive two-dimensional graphic element, a second part of the rectilinear and/or curvilinear elements is printed with a combination of the third and fourth inks, the rectilinear and/or curvilinear elements being subdivided, within said second part, into first and second juxtaposed sections, the first juxtaposed sections being printed with the third ink and the second juxtaposed sections being printed with the fourth ink, wherein, outside the boundaries of the distinctive two-dimensional graphic element, a third portion of the rectilinear and/or curvilinear elements is printed only with the third ink, and a fourth portion of the rectilinear and/or curvilinear elements is printed only with the fourth ink, and wherein the third and fourth inks are printed in register one with respect to the other so that the boundaries of the distinctive two-dimensional graphic element are not visible when the printed security feature is illuminated with visible white light and the distinctive two-dimensional graphic element only becomes visible when the printed security feature is illuminated with non-visible light.

4. The printed security feature according to claim 1, wherein the first graphical representation exhibits a first two-dimensional graphic element which is distinguishable from the distinctive two-dimensional graphic element that becomes visible when the printed security feature is illuminated with non-visible light, the first two-dimensional graphic element and the distinctive two-dimensional graphic element being positioned in a partially overlapping manner within the printed area.

5. The printed security feature according to claim 4, wherein the first two-dimensional graphic element and the distinctive two-dimensional graphic element have identical shapes and are designed in such a way that commutation between the first two-dimensional graphic element and the distinctive two-dimensional graphic element gives the impression of a flip or movement of a same graphic element from one position to another, or wherein the first two-dimensional graphic element and the distinctive two-dimensional graphic element have different shapes each providing recognizable information and are designed in such a way that commutation between the first two-dimensional graphic element and the distinctive two-dimensional graphic element leads to a recognizable change in information.

6. The printed security feature according to claim 1, wherein the multiplicity of adjacent rectilinear and/or curvilinear elements include a first set of rectilinear and/or curvilinear elements extending over a first zone of the printed area and at least a second set of rectilinear and/or curvilinear elements extending over a second zone of the printed area.

7. The printed security feature according to claim 6, wherein the rectilinear and/or curvilinear elements of the first set extend along a first orientation and the rectilinear and/or curvilinear elements of the second set extend along a second orientation different from the first orientation.

8. The printed security feature according to claim 6, wherein the first and second sets of rectilinear and/or curvilinear elements are separated by an unprinted borderline.

9. The printed security feature according to claim 1, wherein the first ink is a first fluorescent ink which produces a visible response having a first fluorescent colour when subjected to the non-visible light excitation, and wherein the first fluorescent colour contributes to making the distinctive two-dimensional graphic element visible when the printed security feature is subjected to the non-visible light excitation.

10. The printed security feature according to claim 9, wherein the second ink is a second fluorescent ink which produces a visible response having a second fluorescent colour when subjected to the non-visible light excitation, which second fluorescent colour is distinct from the first fluorescent colour, and wherein, inside the boundaries of the distinctive two-dimensional graphic element, the first and second juxtaposed sections of the rectilinear and/or curvilinear elements produce, when subjected to the non-visible light excitation, a third fluorescent colour resulting from additive mixture of the first and second fluorescent colours.

11. The printed security feature according to claim 3, wherein the first ink is a first fluorescent ink which produces a visible response having a first fluorescent colour when subjected to the non-visible light excitation, wherein the first fluorescent colour contributes to making the distinctive two-dimensional graphic element visible when the printed security feature is subjected to the non-visible light excitation, and wherein the third ink is a fluorescent ink which produces a visible response having the same or substantially the same first fluorescent colour as the first fluorescent ink when subjected to the non-visible light excitation.

12. The printed security feature according to claim 11, wherein the second ink is a second fluorescent ink which produces a visible response having a second fluorescent colour when subjected to the non-visible light excitation, which second fluorescent colour is distinct from the first fluorescent colour, wherein the fourth ink is a fluorescent ink which produces a visible response having the same or substantially the same second fluorescent colour as the second fluorescent ink when subjected to the non-visible light excitation, and wherein, inside the boundaries of the distinctive two-dimensional graphic element, the first and second juxtaposed sections of the rectilinear and/or curvilinear elements produce, when subjected to the non-visible light excitation, a third fluorescent colour resulting from additive mixture of the first and second fluorescent colours.

13. The printed security feature according to claim 9, wherein the non-visible light excitation is an ultraviolet excitation.

14. The printed security feature according to claim 1, wherein the rectilinear and/or curvilinear elements exhibit a line width in the range of 20 μm to 200 μm.

15. The printed security feature according to claim 1, wherein the rectilinear and/or curvilinear elements exhibit a constant line width.

16. The printed security feature according to claim 1, wherein the rectilinear and/or curvilinear elements are printed with a spatial frequency of 2 to 50 lines per millimeter.

17. The printed security feature according to claim 1, wherein a ratio of a surface of the first juxtaposed sections over a surface of the second juxtaposed sections, inside the boundaries of the distinctive two-dimensional graphic element, lies within a range of ½ to 2.

18. An object comprising a substrate and a printed security feature in accordance with claim 1, which printed security feature is provided onto the substrate.

19. The object according to claim 18, wherein the printed security feature is provided on a portion of the substrate which absorbs a substantial part of the non-visible light excitation.

20. The object according to claim 18, wherein the object is a value document, in particular a high security document such as a banknote, or a security element, in particular a foil element, that is applicable onto an article to be protected against forgery.

21. A process of producing an object comprising a substrate and a printed security feature, wherein the process includes:

providing a printable substrate; and printing the security feature in accordance with claim 1 onto the substrate.

22. The process according to claim 21, wherein the multiplicity of adjacent rectilinear and/or curvilinear elements of the printed security feature is printed by Simultan-offset, namely by inking first and second offset printing plates with the first and second inks, respectively, and by transferring resulting first and second ink patterns from the first and second offset printing plates onto a common blanket cylinder prior to printing.

23. The printed security feature according to claim 11, wherein the non-visible light excitation is an ultraviolet excitation.

* * * * *